US010195623B2

(12) United States Patent
Brand et al.

(10) Patent No.: US 10,195,623 B2
(45) Date of Patent: Feb. 5, 2019

(54) MARKER AIRBRUSH

(71) Applicant: CRAYOLA, LLC, Easton, PA (US)

(72) Inventors: Douglas Brand, Easton, PA (US); Adam Scott Sharp, Sellersville, PA (US); Thomas R. Rau, Easton, PA (US); Adam Sandt, Durham, NC (US); John D. McBride, Jr., Easton, PA (US)

(73) Assignee: Crayola, LLC, Easton, PA (US)

( * ) Notice: Subject to any disclaimer, the term of this patent is extended or adjusted under 35 U.S.C. 154(b) by 81 days.

(21) Appl. No.: 15/408,022

(22) Filed: Jan. 17, 2017

(65) Prior Publication Data

US 2017/0120271 A1 May 4, 2017

Related U.S. Application Data

(60) Continuation-in-part of application No. 14/676,026, filed on Apr. 1, 2015, now Pat. No. 9,713,815, which (Continued)

(51) Int. Cl.
*B05B 7/24* (2006.01)

(52) U.S. Cl.
CPC ..... *B05B 7/2424* (2013.01); *B05B 7/2408* (2013.01); *B05B 7/2413* (2013.01); *B05B 7/2418* (2013.01); *B05B 7/2459* (2013.01)

(58) Field of Classification Search
CPC ..... B05B 1/3026; B05B 7/0416; B05B 7/12; B05B 7/1209; B05B 7/2408;

(Continued)

(56) References Cited

U.S. PATENT DOCUMENTS 5,156,684 A 10/1992 Mayer et al.
5,842,646 A 12/1998 Kitajima (Continued)

FOREIGN PATENT DOCUMENTS

EP 0208247 A1 1/1987

OTHER PUBLICATIONS

Non-Final Office Action dated Nov. 14, 2017 in U.S. Appl. No. 14/676,026, 16 pages.

(Continued)

*Primary Examiner* — Steven J Ganey
*Assistant Examiner* — Cody Lieuwen
(74) *Attorney, Agent, or Firm* — Shook, Hardy & Bacon L.L.P.

(57) ABSTRACT

A marker airbrush device for transferring marking solution from a marking device onto a writing surface using air is provided. The airbrush device includes a housing with an air outlet, a dual-action trigger for controlling an amount of air travelling through the air outlet, and a marker positioner coupled to the housing. The dual-action trigger may be either pushed down or pulled back to control air flow through the air outlet. The marker positioner positions a marking device relative to the air outlet such that air traveling through the air outlet contacts at least one surface of the marking device to transfer marking solution onto a writing surface. The marker positioner may include a rotatable collar that couples the marking device within the marker position and creates a seal around the marking device to prevent pressurized air from escaping around the marking device.

19 Claims, 16 Drawing Sheets

Related U.S. Application Data is a division of application No. 14/089,965, filed on Nov. 26, 2013, now Pat. No. 9,713,815.

(60) Provisional application No. 61/729,833, filed on Nov. 26, 2012.

(58) Field of Classification Search
CPC ... B05B 7/2413; B05B 7/2418; B05B 7/2424; B05B 7/2459; B05B 12/002; B05B 15/62; B05B 15/68
USPC ..... 239/310, 311, 315, 316, 326, 375, 407, 239/414, 415, 420, 433, 434.5, 526–528, 239/583, 586, 600, DIG. 14
See application file for complete search history.

(56) References Cited

U.S. PATENT DOCUMENTS

| | | | | |
|---|---|---|---|---|
| 6,892,960 | B2 | 5/2005 | Ptak et al. | |
| 7,213,774 | B1 * | 5/2007 | Kitajima | B05B 7/1209 239/345 |
| 7,607,591 | B2 | 10/2009 | Barch et al. | |
| 8,052,072 | B2 * | 11/2011 | Kriesmair | B05B 7/2478 239/302 |
| 9,713,815 | B2 * | 7/2017 | Brand | B05B 7/2424 |
| 2003/0071144 | A1 | 4/2003 | Naemura | |
| 2009/0261182 | A1 | 10/2009 | Bolton | |
| 2010/0038453 | A1 | 2/2010 | Barch et al. | |
| 2010/0252143 | A1 | 10/2010 | Juo | |
| 2014/0145011 | A1 | 5/2014 | Brand et al. | |
| 2015/0202641 | A1 | 7/2015 | Brand et al. | |

OTHER PUBLICATIONS

Final Office Action dated Jun. 22, 2017 in U.S. Appl. No. 14/676,026, 16 pages.
Non-Final Office Action dated Dec. 28, 2016 in U.S. Appl. No. 14/089,965, 12 pages.
Final Office Action dated Aug. 31, 2016 in U.S. Appl. No. 14/089,965, 23 pages.
Non-Final Office Action dated Apr. 29, 2016 in U.S. Appl. No. 14/089,965, 22 pages.
Final Office Action dated Oct. 28, 2015 in U.S. Appl. No. 14/089,965, 13 pages.
Non-Final Office Action dated May 7, 2015 in U.S. Appl. No. 14/089,965, 12 pages.
Perfect Spritzer Tool, 2 pages. _ast accessed Oct. 8, 2015 at: http://www.createandcraft.com/search/perfect-spritzer?fh_location=//CreateAndCraftUS/en_US/$s=perfect% 20spritzer&gs=perfect% 20spritzer.
Copic Airbrush System, 2 pages. _ast accessed Oct. 8, 2015 at: http://www.dickblick.corn/products/copic-airbrush-system/.
Barbie Airbrush Designer, 1 page. Last accessed Oct. 8, 2015 at: http://shop.mattel.com/product/index.jsp?productId=65561606.
RoseArt Extreme Airbrush, 4 pages. Last accessed Oct. 8, 2015 at: http://ttpm.com/p/5006/roseart/extreme-air-brush-studio.
Non-Final Office Actions dated Feb. 17, 2017 in U.S. Appl. No. 14/676,026, 17 pages.
Final Office Action dated Apr. 18, 2018 in U.S. Appl. No. 14/676,026, 13 pages.

* cited by examiner

MARKER AIRBRUSH

CROSS-REFERENCE TO RELATED APPLICATIONS

This application is a continuation-in-part of and claims priority to U.S. Nonprovisional application Ser. No. 14/676,026, titled "Marker Airbrush," filed Apr. 1, 2015, which is a divisional of U.S. Nonprovisional application Ser. No. 14/089,965, titled "Marker Airbrush," filed Nov. 26, 2013, which claims priority to U.S. Provisional Application No. 61/729,833, titled "Marker Airbrush," filed Nov. 26, 2012, the entire disclosure of each of which is hereby incorporated by reference.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed description section below. This summary is not intended to identify key features or essential features of the claimed subject matter, nor is it intended to be used as an aid in isolation to determine the scope of the claimed subject matter. In brief and at a high level, this disclosure describes, among other things, a marker airbrush device for transferring marking solution from a marking device onto a writing surface using air. The marker airbrush device includes a housing with an air outlet and a marker positioner. In embodiments, the housing is coupled to a dual-action trigger that controls an amount of air traveling through the air outlet. The dual-action trigger may include two triggers to provide at least two different ways to use the trigger. Additionally, in embodiments, the marker positioner holds the marker at a particular depth relative to the air outlet. The marker positioner may include a rotatable collar that couples a marking device to the marker positioner.

DESCRIPTION OF THE DRAWINGS

Illustrative embodiments of the invention are described in detail below with reference to the attached drawing figures, and wherein.

DETAILED DESCRIPTION

Figure 1:
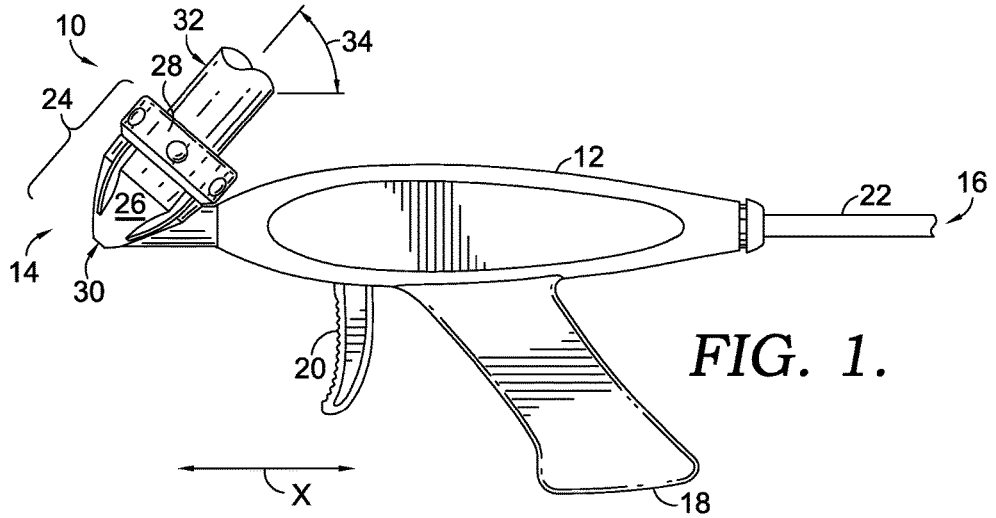
FIG. 1 is a side view of a marker airbrush device with a marking device coupled to the marker airbrush device, in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

In one embodiment of the invention, a marker airbrush device includes a housing comprising an air outlet and a trigger for controlling an amount of air travelling through the air outlet; and a marker positioner coupled to the housing, wherein the marker positioner positions at least a portion of a marking device relative to the air outlet such that air traveling through the air outlet contacts at least a portion of the marking device to transfer marking solution from the marking device onto a writing surface.

In another embodiment of the invention, a marker airbrush device includes a housing having a first end and a second end, the housing comprising an air outlet, an opening through which air travelling through the air outlet exits the housing, and a trigger for controlling an amount of air travelling through the air outlet; a marker positioner coupled to the first end of the housing, wherein the marker positioner positions at least a portion of a marking device at a particular depth relative to the air outlet such that air traveling through the air outlet contacts at least one surface of the marking device to transfer marking solution from the marking device onto a writing surface, wherein the marker positioner comprises a rotatable collar for adjusting a position of at least a portion of the marking device at the particular depth relative to the air outlet, wherein at least a portion of the rotatable collar rotates around a circumference of a marker housing of the marking device, and further wherein the marker positioner comprises a height adjustment mechanism coupled to the rotatable collar, wherein rotation of the rotatable collar in a first direction advances the marking device into a path of air flowing through the air outlet based on travel of the height adjustment mechanism relative to the housing, and wherein rotation of the rotatable collar in a second direction retracts the marking device from the path of air flowing through the air outlet based on travel of the height adjustment mechanism relative to the housing; and a hand-pumping device coupled to the second end of the housing, the hand-pumping device adapted to pump air through the air outlet.

In a further embodiment, a marker airbrush device includes a housing having a first end and a second end, the housing comprising: an air outlet, a trigger for controlling an amount of air travelling through the air outlet; a marker positioner coupled to the first end of the housing, wherein the marker positioner positions at least a portion of a marking device at an angle relative to the housing such that air traveling through the air outlet contacts at least one surface of the marking device, wherein the marker positioner comprises a hollow interior tapered towards the opening and a stabilizing ring that secures the position of the marking device inside the marker positioner; and an opening through which air traveling through the air outlet exits the marker positioner.

In an embodiment, a marker airbrush device comprises an airbrush housing and a marker positioner. The airbrush housing has a first end and a second end oriented along a horizontal axis and includes an air outlet through which air travels and a dual-action trigger comprising a top trigger and a bottom trigger. The dual-action trigger is configured to control the amount of air traveling through the air outlet by moving at least the top trigger or at least the bottom trigger. The marker positioner is coupled to the first end of the airbrush housing and includes an opening through which air traveling through the air outlet exits the marker airbrush device. The marker positioner positions at least a portion of a marking device at a particular depth relative to the air outlet and at a particular angle with respect to the horizontal axis such that air traveling through the air outlet contacts at least one surface of the marking device to transfer marking solution from the marking device onto a writing surface external to the airbrush housing.

In another embodiment, a marker airbrush device includes an airbrush housing having a first end and a second end oriented along a horizontal axis and including an air outlet with an opening through which air travels. The airbrush housing may also include a dual-action trigger comprising a top trigger and a bottom trigger, wherein the dual-action trigger is configured to control the amount of air traveling through the air outlet by moving at least the top trigger or at least the bottom trigger. The marker airbrush device further comprises a marker positioner coupled to the first end of the airbrush housing and that includes an opening through which air traveling from the air outlet exits the marker airbrush device and an interior cavity in which at least a portion of a marking device is positioned. The marker positioner positions at least a portion of a marking device at a particular depth relative to the air outlet and at a particular angle with respect to the horizontal axis such that air traveling through the air outlet contacts at least one surface of the marking device to transfer marking solution from the marking device onto a writing surface external to the airbrush housing. The marker airbrush device may also include a rotatable collar for removeably coupling at least a portion of the marking device to at least a portion of the marker positioner when the marking device is positioned within the interior cavity of the marker positioner.

In another embodiment, a marker airbrush device comprises an airbrush housing, a marker positioner, and a rotatable collar. The airbrush housing has a first end and a second end oriented along a horizontal axis and includes an air outlet at the first end through which air travels. The airbrush housing also includes a dual-action trigger, wherein the dual-action trigger comprises a top trigger and a bottom trigger and is configured to control an amount of air traveling through the air outlet by moving at least the top trigger or at least the bottom trigger.

The marker positioner is coupled to the first end of the airbrush housing and includes an opening through which air traveling through the air outlet exits the marker airbrush device and an interior cavity in which at least a portion of a marking device is positioned. The marker positioner positions at least a portion of a marking device at a particular depth relative to the air outlet and at a particular angle less than 90 degrees with respect to the horizontal axis such that air traveling through the air outlet contacts at least one surface of the marking device to transfer marking solution from the marking device onto a writing surface. The rotatable collar removeably couples at least a portion of the marking device to at least a portion of the marker positioner when the marking device is positioned within the interior cavity of the marker positioner.

Referring initially to FIG. 1, a marker airbrush device 10 is depicted in accordance with an embodiment of the invention. The marker airbrush device 10 includes a housing 12 having a first end 14 and a second end 16 arranged along a central x-axis. The airbrush device 10 includes a handle 18 and a trigger 20. Although depicted as a lever to be pulled in relation to the handle 18, the trigger 20 may be any sort of device used to provide an indication of stopping and starting the flow of air through the marker airbrush device 10. For example, the trigger 20 may be a button or a sensor that a user contacts to indicate when air should flow through marker airbrush device 10.

Marker airbrush device 10 further includes a piece of tubing 22 coupled to the second end 16 of the housing 12. The tubing 22 provides an input for an air source, such as the air pump device 46 discussed below with reference to FIGS. 5 and 6. In embodiments, air pumped into the second end 16 of the housing 12 travels through the housing 12 (via air outlet 40 depicted in FIG. 2) and exits the airbrush device 10 via opening 30, after passing through the marker positioner 24. Embodiments of the marker positioner 24 include a conical tip 26, a rotatable collar 28 that rotates around a circumference of a marking device 32, and an opening 30. As shown in FIG. 1, a marking device 32 may be secured by the marker positioner 24, and positioned at an angle 34 relative to the horizontal x-axis of the marker airbrush device 10.

Figure 2:
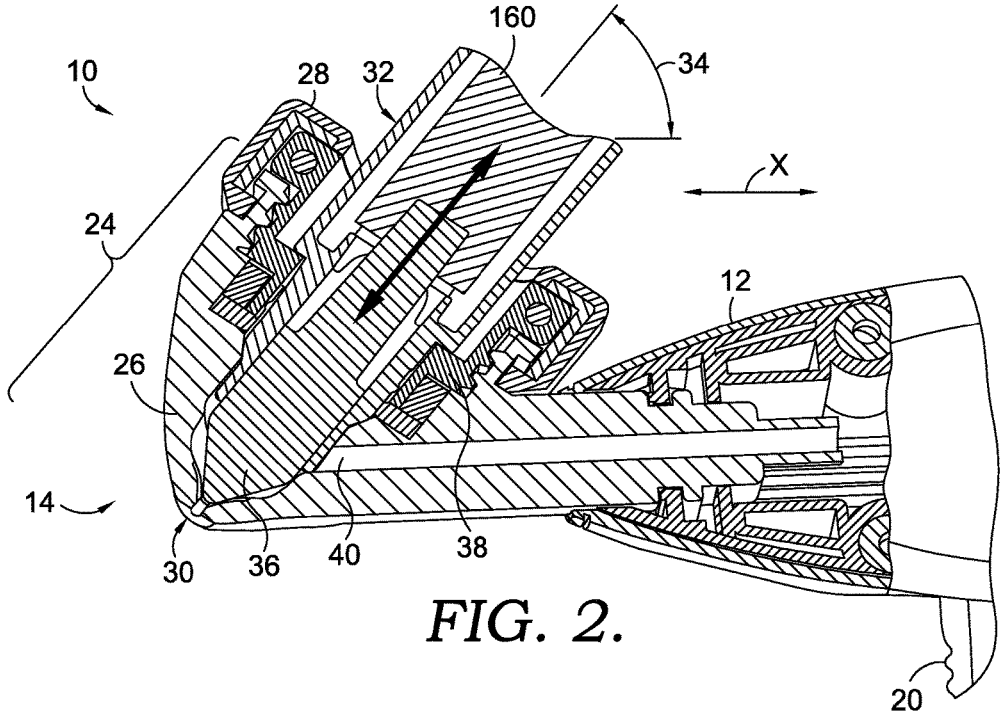
FIG. 2 is an enlarged, side view of the marker airbrush device of FIG. 1, partially tilted away from the plane of view, with a portion of the marker airbrush device and the marking device cut away, in accordance with an embodiment of the invention.

In one embodiment, the marker positioner 24 is used to adjust the position of the marking device 32 with respect to one or more parts of the marker airbrush device 10. With reference to FIG. 2, a cut-away portion of the marker airbrush device 10 includes the marking device 32 with a marker nib 36 adjoining a marker reservoir 160. In embodiments, the marker nib 36 and/or marker reservoir 160 is saturated with an amount of marking solution. In the embodiment of FIG. 2, marker nib 36 is depicted as having a pointed configuration at a first end of the marker nib 36. FIG. 2 also depicts the height adjustment mechanism 38 coupled to the rotatable collar 28 of the marker positioner 24. In one example, rotation of the rotatable collar 28 in a first direction may advance the marking device 32 into a path of air flowing through the air outlet 40 based on travel of the height adjustment mechanism 38 relative to the housing 12. Further, rotation of the rotatable collar 28 in a second direction may retract the marking device 32 from the path of air flowing through the air outlet 40 (and exiting the housing 12 via opening 30) based on travel of the height adjustment mechanism 38 relative to the housing 12. As depicted in FIG. 2, air flowing through air outlet 40 may travel across the marker nib 36, collect an amount of marking solution in the air stream, and release a spray of marking solution out of the opening 30, thereby creating an "airbrush" effect. In other words, the marker airbrush device 10 may transfer marking solution from the marking device 32 (i.e., from the marker nib 36) out of the first end 14 of the marker airbrush device 10, and onto a writing surface.

Embodiments of the invention may utilize many kinds of marking devices 32, having marker nibs 36 and/or marker reservoirs 160 saturated with multiple types of marking solutions. For example, the marker airbrush device 10 may be used with a variety of broad line markers, such as Regular, Washable, Pip-Squeaks®, Crystal Effects, Window and Bright Fabric markers, by Crayola® LLC of Easton, Pa. As such, embodiments of the marking solution may be a washable marker solution, a non-washable marker solution, a fabric-writing marker solution, a window-writing marker solution, a special-effects marker solution and/or a permanent marker solution. In one embodiment, a marker device secured by the marker airbrush device 10 is a regular-sized marking device having a standard-sized barrel and/or housing diameter, while in other embodiments, the marker device secured by the marker airbrush device 10 is a miniature-sized marking device having a barrel and/or housing that is smaller in diameter than the regular-sized marking device. As such, the marker airbrush device 10 may be adjusted for use with either regular-sized or miniature-sized marking devices. Additionally, the marker airbrush device 10 may be used to transfer solution from a variety of marking devices 32, including but not limited to markers having a marker nib 32 saturated in marking solution. In embodiments, marking device 32 is removable from marker airbrush device 10, such that multiple different marking devices may be used individually with marker airbrush device 10.

Figure 3:
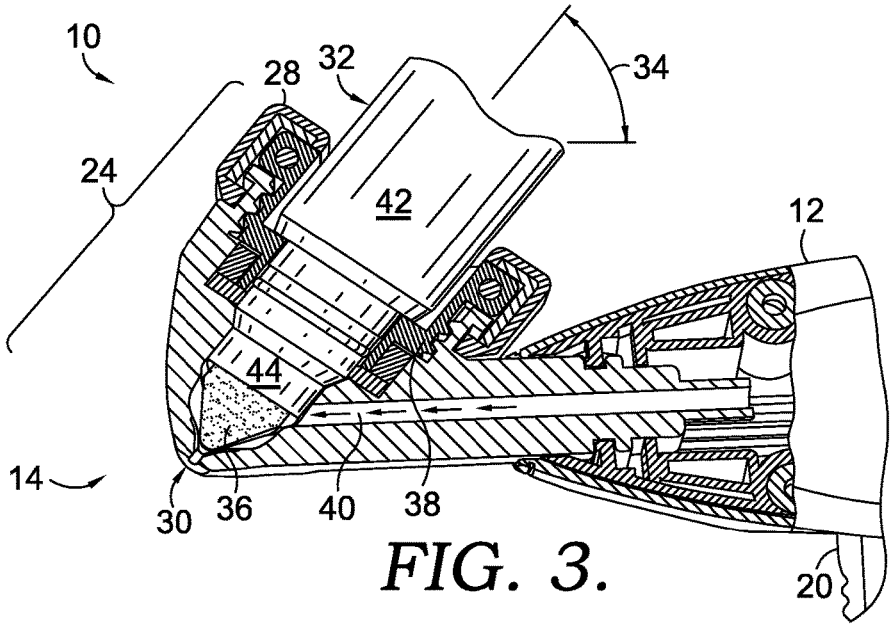
FIG. 3 is an enlarged, side view of the marker airbrush device of FIG. 1, partially tilted away from the plane of view, with a portion of the marker airbrush device cut away, in accordance with an embodiment of the invention.

Turning now to FIG. 3, additional exemplary details of the marker airbrush device 10 of FIG. 1 are depicted with a portion of the housing 12 cut away to reveal how the air flowing through air outlet 40 contacts one or more surfaces of a marking device 32. In one embodiment, the marker housing 42 that encloses marking device 32 is shown as being secured by the adjustment mechanism 38 and/or rotatable collar 28 of the marker positioner 24. The marker housing 42 of the marking device 32 also includes a marker housing collar 44 near the tip of the marking device 32. In one embodiment, air flowing through the air outlet 40 passes over both a portion of the marker housing collar 44 and a portion of the marker nib 36 prior to exiting the housing 12 via opening 30 (at the first end 14 of the marker airbrush device 10).

Accordingly, adjustment of a height and/or depth of the marking device 32 (relative to the interior of the air outlet 40) by the marker positioner 24 may adjust the portion of the marking device 32 that is contacted by the air flow through air outlet 40. In one embodiment, a portion of the marker housing collar 44 and a portion of the marker nib 36 are contacted by air flowing through the air outlet 40. In some embodiments, the path of such flowing air is altered by the contact with the marker housing collar 44 and/or the marker nib 36. As such, the resulting airbrush spray of marking solution from the marking device 32 may be altered by the depth of the placement of the marking device 32 (i.e., by how much of the marker nib 36 and/or marker housing collar 44 are held in the path of the air flow by the marker positioner 24). Further, in additional embodiments, rotation of the rotatable collar 28 and the corresponding travel of the adjustment mechanism 38 may be used to advance or retract the marking device 32 into or away from the air outlet 40, such that different amounts of the marking device 32 may interfere with the air flowing through air outlet 40.

In one embodiment, marking device 32 is secured at a first position relative to the housing 12 and/or air outlet 40, by the marker positioner 24. Upon adjustment of the marker positioner 24, based on rotation of the rotatable collar 28 and travel of the adjustment mechanism 38, the marking device 32 may be shifted into a second position relative to the housing 12 and/or the air outlet 40. In other words, the marker positioner 24 may adjust the position of the marking device 32 from a first position to a second position, thereby altering the depth of the marker nib 36 (and/or marker housing collar 44) as inserted into the stream of air flowing through air outlet 40. In some embodiments, an amount of marking solution carried by the air flowing through air outlet 40 (and across the marker nib 36) may be altered by the depth of placement of the marking device 32. For example, advancement from a first position to a second, closer position, may cause more marking solution to be transferred from the marking device 32 to a marking surface, such as a piece of paper. Similarly, in another example, retraction from a second position to a first, more distant position, may cause less marking solution to be transferred from the marking device 32 to a marking surface. As such, an amount of marking solution used to create an "airbrush" effect may be altered by the adjustment mechanism 38 of the marker positioner 24, based on rotation of the rotatable collar 28.

Figure 4:
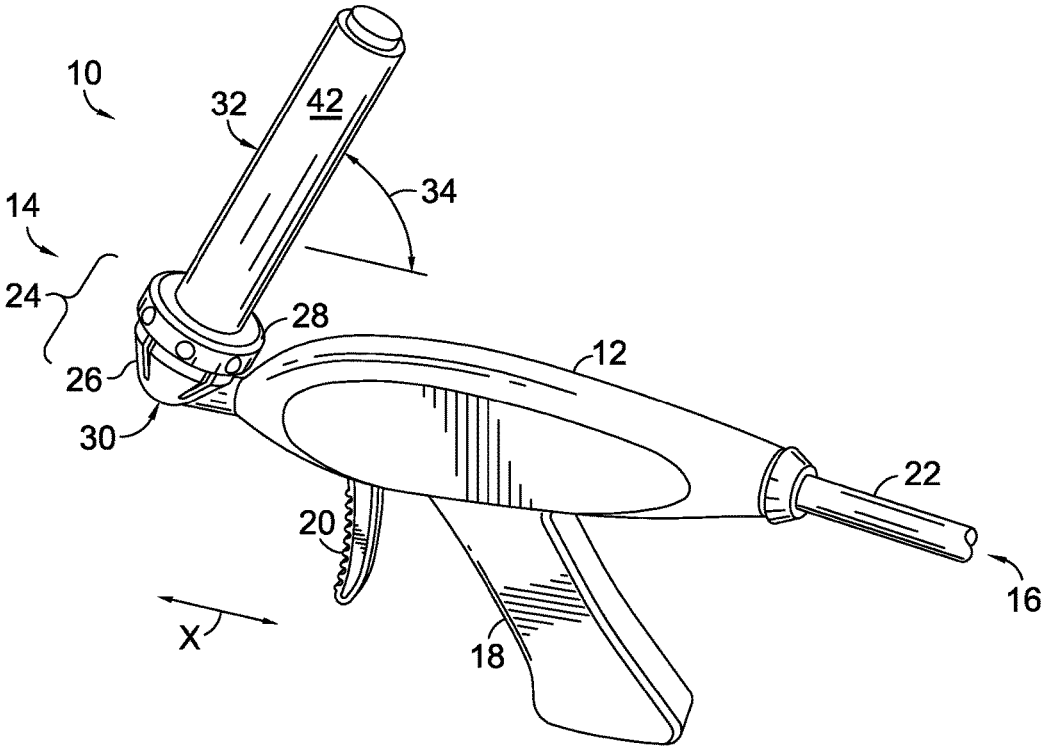
FIG. 4 is a rear, perspective view of the marker airbrush device of FIG. 1, in accordance with an embodiment of the invention.

With reference to FIG. 4, a rear perspective view of the marker airbrush device 10 depicts the cylindrical shape of the marker housing 42, and the circular shape of the rotatable collar 28 of the marker positioner 24. In one embodiment, depression of the trigger 20 causes air to be passed through the tubing 22, through the air outlet 40 (shown in FIGS. 2-3) of the housing 12, through at least a portion of the marker positioner 24, and out the opening 30. In embodiments, to adjust the spray of airbrushed marking solution that exits the opening 30 with the air flow, rotatable collar 28 may be rotated to adjust the depth of the marking device 32 that is in contact with the air flow. Accordingly, marker positioner 24 may maintain the angle 34 of placement of the marking device 32 relative to the x-axis while adjusting the height and/or depth of the marking device 32 relative to the air outlet 40 and/or housing 12.

Figure 5:
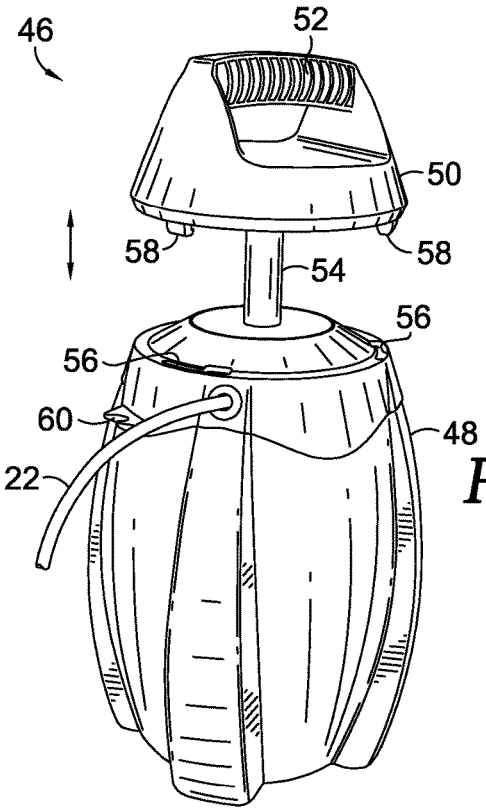
FIG. 5 is a perspective view of a hand-pumped air-pumping device in an extended position, in accordance with an embodiment of the invention.
Figure 6:
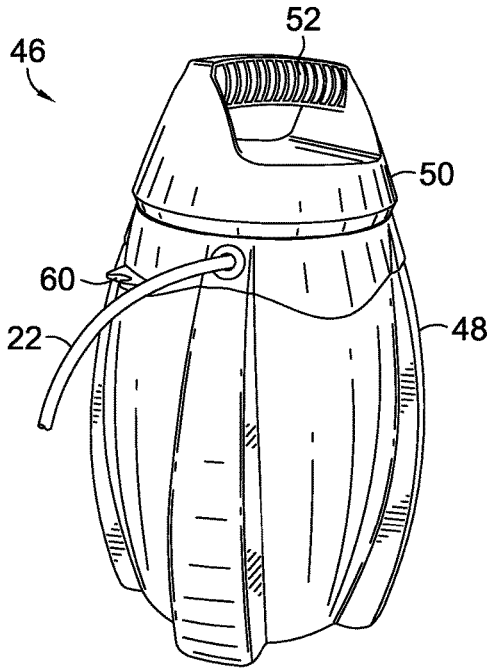
FIG. 6 is a perspective view of a hand-pumped air-pumping device in a compressed position, in accordance with an embodiment of the invention.

Referring next to FIGS. 5 and 6, a hand-pumped air-pumping device 46 includes a pump housing 48, an upper housing 50 with a handle 52, and a center pump guide 54. The upper housing 50 travels vertically with respect to the pump housing 48, along the center pump guide 54, to produce an amount of air to be forced into the marker airbrush device 10 of FIG. 1, via tubing 22. As shown in the extended position of FIG. 5, a user may pump the air-pumping device 46 vertically with respect to the pump housing 48 and upper housing 50. In embodiments, upper housing 50 may be secured to the pump housing 48 when in a compressed position, by mating the slots 56 around the perimeter of the pump housing 48 with the tabs 58 around the perimeter of the upper housing 50. In embodiments, airbrush holster 60 may be coupled to a portion of the housing 12 of the marker airbrush device 10 (shown in FIG. 1). As such, in one embodiment, tubing 22 is coupled to the second end 16 of the marker airbrush device 10, and to the pump housing 48 of the air-pumping device 46.

As will be understood, the exemplary air-pumping device 46 is only one example of a hand-powered air-pumping device that can be used to pump air through the marker airbrush device 10. Although embodiments of the invention are described above with respect to air pumped from a hand-pumping device, such is not intended to limit embodiments to any particular device or configuration for providing air to flow through the marker airbrush device 10. Accordingly, in some embodiments, a mechanical, automatic, electrically powered, and/or partially manually powered pumping device may be used to provide air to the marker airbrush device 10. For example, though not illustrated, it is contemplated that the air source for the marker airbrush device 10 may be a motorized air pump that provides a constant stream of pressurized air when the pump is running.

Figure 7:
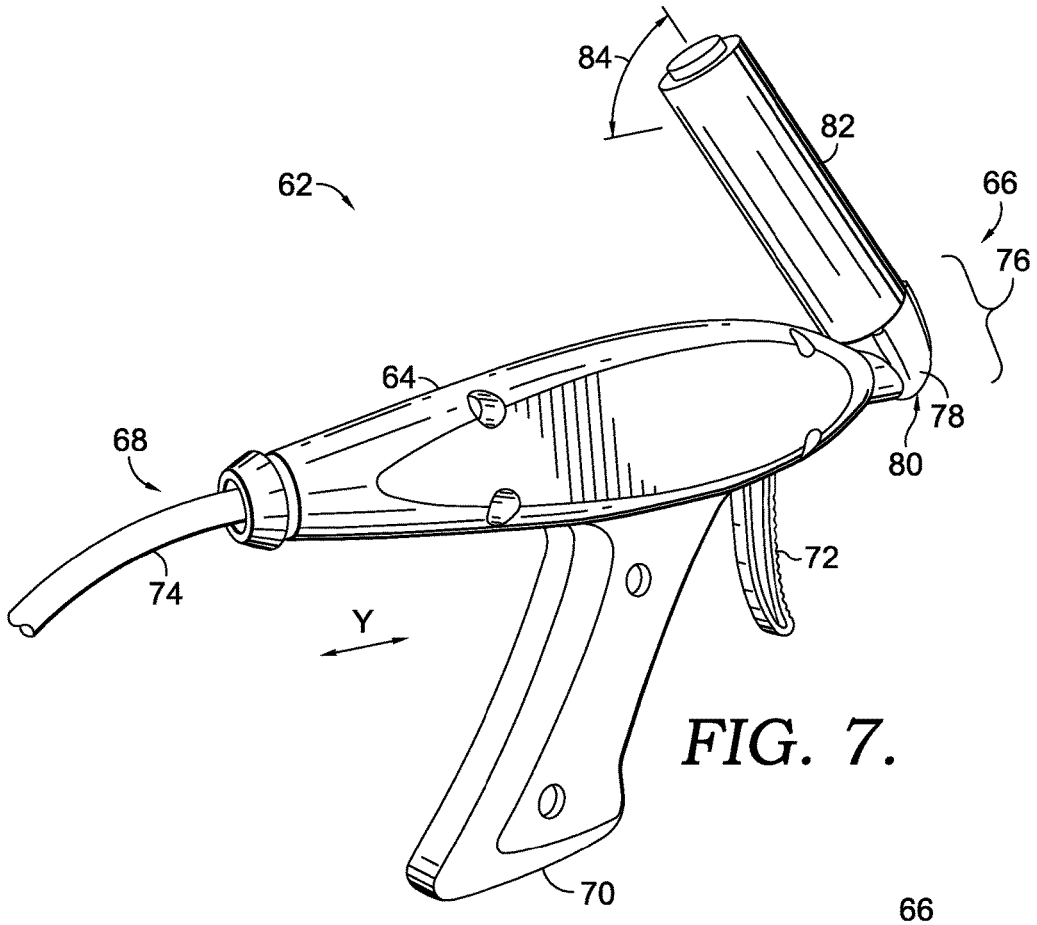
FIG. 7 is a perspective view of a marker airbrush device, with a marking device coupled to the marker airbrush device, in accordance with an embodiment of the invention.

Turning now to FIG. 7, a marker airbrush device 62 is depicted in accordance with an embodiment of the invention. The marker airbrush device 62 includes a housing 64 having a first end 66 and a second end 68 arranged along a central y-axis. The airbrush device 62 includes a handle 70 and a trigger 72. Although depicted as a lever to be pulled in relation to the handle 70, the trigger 72 may be any sort of device used to provide an indication of stopping and starting the flow of air through the marker airbrush device 62. For example, the trigger 72 may be a button or a sensor that a user contacts to indicate when air should flow through marker airbrush device 62.

Marker airbrush device 62 further includes a piece of tubing 74 coupled to the second end 68 of the housing 64. The tubing 74 provides an input for an air source, such as the air pump device 46 discussed above with reference to FIGS. 5 and 6. In embodiments, air pumped into the second end 68 of the housing 64 travels through the housing 64 (via air outlet 86 depicted in FIG. 8) and exits the airbrush device 62 via opening 80, after passing through the marker positioner 76. Embodiments of the marker positioner 76 include a conical tip 78 that accepts the marking end of a marking device 82. The marking device 82 may have a marker nib that is saturated with an amount of marking solution, such that the solution saturating the marking device is "airbrushed" onto a surface based on air traveling through the marker airbrush device 62. As shown in FIG. 7, a marking device 82 may be secured by the marker positioner 76, and positioned at an angle 84 relative to the horizontal y-axis of the marker airbrush device 62.

Figure 8:
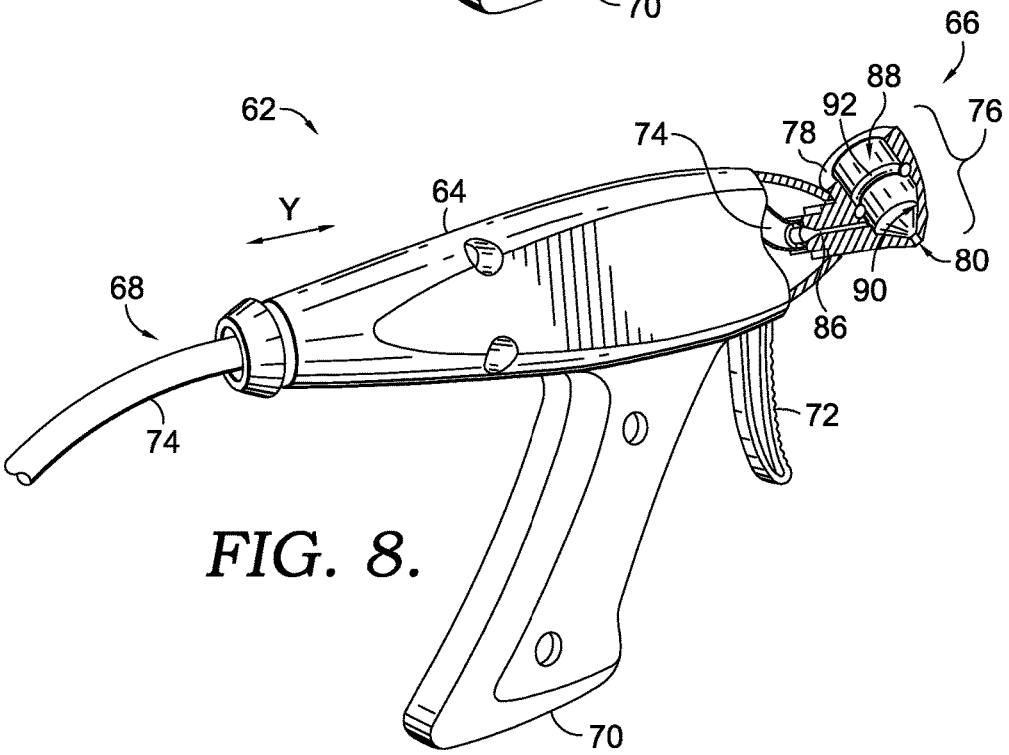
FIG. 8 is a perspective view of the marker airbrush device of FIG. 7, with a portion of the marker airbrush device cut away in accordance with an embodiment of the invention.

In one embodiment, the marker positioner 76 positions the marking device 82 with respect to one or more parts of the marker airbrush device 62. With reference to FIG. 8, a cut-away portion of the marker airbrush device 62 includes a conical tip 78 that tapers towards the opening 80. Air traveling from tubing 74 through the air outlet 86 enters the hollow interior 88 of the conical tip 78. The hollow interior 88 has a tapered surface 90 near the opening 80 and a stabilizing ring 92 that secures the position of the marking device 82 inside the marker positioner 76. The stabilizing ring 92 surrounds at least a portion of the circumference of the hollow interior 88, and may be made of any material that creates resistance against the outer surface of a marking device 82, such as a rubber gasket.

In one embodiment, coupling of the marking device 82 with the stabilizing ring 92 secures the marking device 82 inside the marker positioner 76 such that the air flowing from the air outlet 86 contacts at least a portion of the marker nib on the marking device 82. In some embodiments, the air from air outlet 86 contacts at least a portion of a collar of the marking device and at least a portion of the marker nib. As such, air contacting the marking device 82 may be "targeted" to contact a particular portion of the marking device 82 based on positioning of the marking device 82 inside marker positioner 76 (and the corresponding orientation of the marking device 82 inside the hollow interior 88). In one example, air flowing through air outlet 86 may travel across the nib of the marking device 82, collect an amount of marking solution in the air stream, and release a spray of marking solution out of the opening 80 to create an "airbrush" effect. In other words, the marker airbrush device 62 may transfer marking solution from the marking device 82

(i.e., from the marker nib) out of the first end 66 of the marker airbrush device 62, and onto a writing surface.

Embodiments of the invention may utilize many different kinds of marking devices 82, having marker nibs and/or marker reservoirs saturated with multiple different types of marking solutions. For example, the marker airbrush device 62 may be used with a variety of broad line markers, such as Regular, Washable, Pip-Squeaks®, Crystal Effects, Window and Bright Fabric markers, by Crayola® LLC of Easton, Pa. Additionally, the marker airbrush device 62 may be used to transfer solution from a variety of different types of marking devices 82, including but not limited to markers having a marker nib saturated in marking solution. In embodiments, marking device 82 is removable from marker airbrush device 62, such that multiple different marking devices may be used individually with marker airbrush device 62. In some embodiments, stabilizing ring 92 may be adapted to secure different types of marking devices 82, such as marking devices having different circumferences or different shaped housings and/or nibs. In one embodiment, a marker device 82 secured by the marker airbrush device 62 is a regular-sized marking device 82 having a standard-sized barrel and/or housing diameter, while in other embodiments, the marker device 82 secured by the marker airbrush device 62 is a miniature-sized marking device 82 having a barrel and/or housing that is smaller in diameter than the regular-sized marking device.

Figure 9:
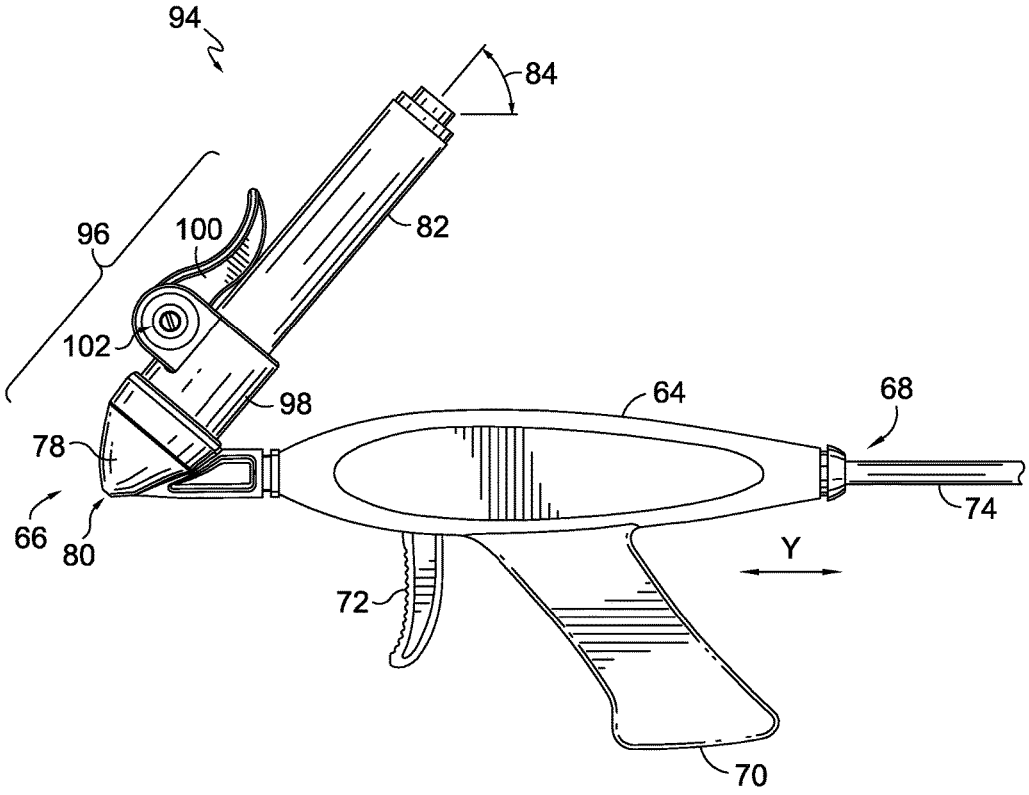
FIG. 9 is a side view of a marker airbrush device with a marking device coupled to the marker airbrush device, in accordance with an embodiment of the invention.
Figure 10:
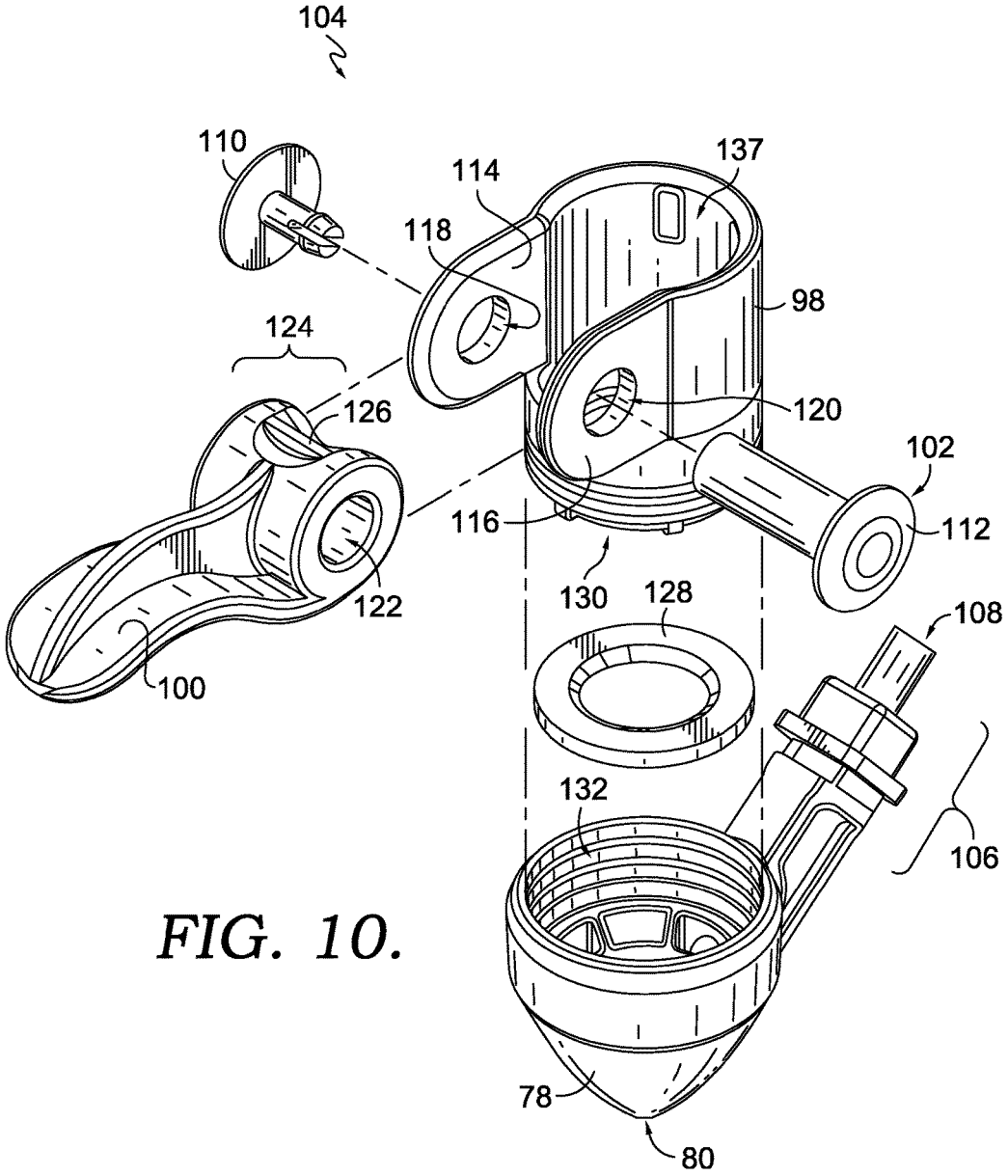
FIG. 10 is an expanded, perspective view of a marker positioner of the marker airbrush device of FIG. 9, in accordance with an embodiment of the invention.

In FIGS. 9-10, a marker airbrush device 94 is depicted in accordance with an embodiment of the invention. The exemplary marker airbrush device 94 of FIG. 9 includes a housing 64 having a first end 66 and a second end 68 arranged along a central y-axis. The airbrush device 94 includes a handle 70 and a trigger 72. Although depicted as a lever to be pulled in relation to the handle 70, the trigger 72 may be any sort of device used to provide an indication of stopping and starting the flow of air through the marker airbrush device 94. For example, the trigger 72 may be a button or a sensor that a user contacts to indicate when air should flow through marker airbrush device 94.

Marker airbrush device 94 further includes a piece of tubing 74 coupled to the second end 68 of the housing 64. The tubing 74 provides an input for an air source, such as the air pump device 46 discussed above with reference to FIGS. 5 and 6. In embodiments, air pumped into the second end 68 of the housing 64 travels through the housing 64 (via air outlet 86 depicted in FIG. 8) and exits the airbrush device 94 via opening 80, after passing through the marker positioner 96. Embodiments of the marker positioner 96 include a conical tip 78 that accepts the marking end of a marking device 82. The marking device 82 may have a marker nib that is saturated with an amount of marking solution, such that the solution saturating the marking device is "airbrushed" onto a surface based on air traveling through the marker airbrush device 94. As shown in FIG. 9, a marking device 82 may be secured by the marker positioner 96, and positioned at an angle 84 relative to the horizontal y-axis of the marker airbrush device 94.

In one embodiment, the marker positioner 96 positions the marking device 82 with respect to one or more parts of the marker airbrush device 94. As shown in the example of FIG. 9, the marker positioner 96 includes a marker collar 98 that secures the marking device 82 based on a position of the locking lever 100. As discussed below with reference to FIGS. 11-13, locking level 100 pivots about a rotation joint 102 into one of multiple positions with respect to the marker airbrush device 94 and/or the marking device 82. In embodiments, the locking lever 100 may be engaged in two different positions to secure different types of marking devices 82. In one embodiment, the locking lever 100 is adjusted into a first position with at least a first portion of the locking lever 100 directly adjoining an exterior surface of the marking device 82. In a further embodiment, the locking lever 100 may be adjusted into a second position with at least a second portion of the locking lever 100 directly adjacent an exterior surface of the marking device 82. For example, the locking lever 100 may be adjusted into a first position when securing a miniature-sized marking device 82, while the locking lever 100 may be further adjusted into a second position when securing a regular-sized marking device 82.

In the expanded, perspective view of FIG. 10, the components 104 of marker positioner 96 include the marker collar 98 that engages with the locking lever 100 and is secured by fastener 110 upon mating with pin 112. In particular, marker collar 98 includes arms 114 and 116 that extend from the marker collar 98 and include corresponding openings 118 and 120. As such, at rotation joint 102, the pin 112 is inserted through opening 120 of arm 116, opening 122 of locking lever 100, and opening 118 of arm 114, and further coupled to fastener 110 to restrict lateral movement of the pin 112 with respect to the marker collar 98. In embodiments, locking lever 100 is rotatably coupled (at rotation joint 102) to the marker collar 98 based on mating of the fastener 110 to the pin 112, which is inserted through arms 116 and 118 and opening 122.

In further embodiments, based on movement of locking lever 100 about rotation joint 102, the positioning mechanism 124 of the locking lever 100 includes a locking segment 126 that engages against at least a portion of a marking device, such as a front end of a marking device 82. As such, a marker positioner 96 may include a locking lever 100 having one or more locking segments 126 that engage against an outer surface of marking device, such as a collar and/or tip of a marking device 82. In embodiments, positioning mechanism 124 is an s-detent on a surface of the locking lever 100, while locking segment 126 is a standing rib that spans at least a portion of the positioning mechanism 124. In further embodiments, positioning mechanism 124 includes multiple locking segments 126 having varying heights within the s-detent of positioning mechanism 124, to provide varying locking positions of the locking lever 100. Accordingly, in further embodiments, one or more locking segments 126 are configured to mate against one or more different sizes of marking devices 82. In one embodiment, each locking segment 126 coupled to a positioning mechanism 124 is configured to mate against a particular-sized marking device 82, such as a first locking segment 126 configured to mate against a miniature-sized marking device 82, and a second locking segment 126 configured to mate against a regular-sized marking device 82.

As further shown in the enlarged view of FIG. 10, the components 104 of marker positioner 96 may include a connection mechanism 106 (having tubing 108) for connecting the marker positioner 96 and conical tip 78 to a remainder of the housing 64 and related components of the marker airbrush device 94, as well as a stabilizing ring 128 that secures the marker collar 98 against the interior cavity 132 of the conical tip 78. In embodiments, stabilizing ring 128 is an O-ring made of a material that mates to surfaces of the neighboring components, such as a thermoplastic elastomer (TPE) and/or rubber stabilizing ring 128. As shown in FIG. 10, the interior cavity 132 of the conical tip 78 includes a ribbed surface that engages against the nib of a marking device, such as the nib 36 of marking device 32 in FIG. 3. In some embodiments, the marker positioner 96 includes a series of ribs and/or protrusions on the interior cavity 132 that hold the nib of a marking device at a particular depth inside of the conical tip 78. In further embodiments, based on the nib of a marker device adjoining one or more of the ribbing structures on the interior cavity 132 of the conical tip 78, the marker positioner 96 maintains a constant distance between the marker nib and the opening 80 (and/or air outlet 86).

In embodiments, the stabilizing ring 128 restricts movement of the tip of a marking device secured by the marker positioner 96. In one embodiment, coupling of the marking device 82 with the stabilizing ring 128 secures the marking device 82 inside the marker positioner 76 such that the air flowing from an air outlet contacts at least a portion of the marker nib on the marking device 82. In some embodiments, air flowing through the marker airbrush device 94 contacts at least a portion of a collar of the marking device 82 and at least a portion of the marker nib. As such, air contacting the marking device 82 may be "targeted" to contact a particular portion of the marking device 82 based on positioning of the marking device 82 by the marker positioner 96 (and the corresponding orientation of the marking device 82 inside the hollow interior 132). In one example, air flowing through marker airbrush device 94 may travel across the nib of the marking device 82, collect an amount of marking solution in the air stream, and release a spray of marking solution out of the opening 80 to create an "airbrush" effect. In other words, the marker airbrush device 94 may transfer marking solution from the marking device 82 (i.e., from the marker nib) out of the first end 66 of the marker airbrush device 94, and onto a writing surface, based on securing the marking device 82 with the marker positioner 96.

As previously discussed, embodiments of the invention may utilize many different kinds of marking devices 82, having marker nibs saturated with multiple different types of marking solutions. For example, the marker airbrush device 94 may be used with a variety of broad line markers, such as Regular, Washable, Pip-Squeaks®, Crystal Effects, Window and Bright Fabric markers, by Crayola® LLC of Easton, Pa. As such, embodiments of the marking solution may be a washable marker solution, a non-washable marker solution, a fabric-writing marker solution, a window-writing marker solution, a special-effects marker solution and/or a permanent marker solution. Additionally, the marker airbrush device 94 may be used to transfer solution from a variety of different types of marking devices 82, including but not limited to markers having a marker nib and/or marker reservoir saturated in marking solution. In embodiments, marking device 82 is removable from marker airbrush device 94, such that multiple different marking devices may be used individually with marker airbrush device 94. In some embodiments, stabilizing ring 128 may be adapted to secure different types of marking devices 82, such as marking devices having different circumferences or different shaped housings and/or nibs. In embodiments, the marker positioner 96 of marker airbrush device 94 may be maneuvered into different locking positions corresponding to the outer surface of a regular-sized marking device or the outer surface of a miniature-sized marking device.

Figure 11:
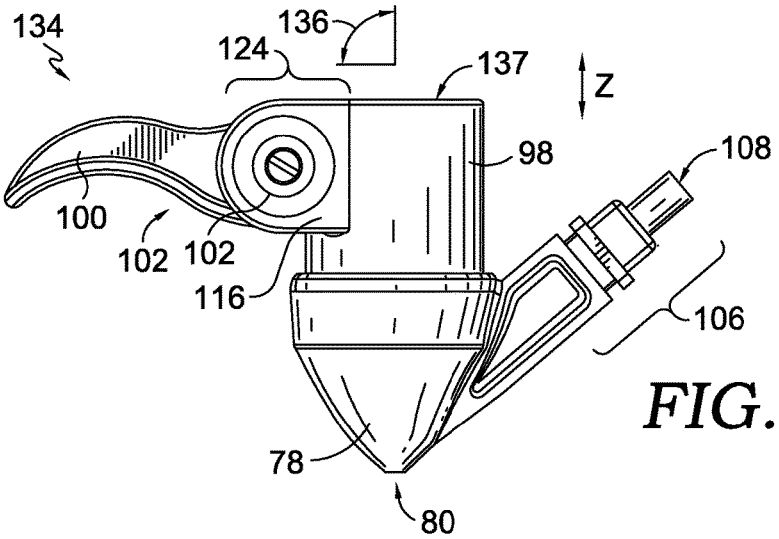
FIG. 11 is a side view of an unlocked marker positioner for securing a marking device in a marker airbrush device, in accordance with an embodiment of the invention.
Figure 12:
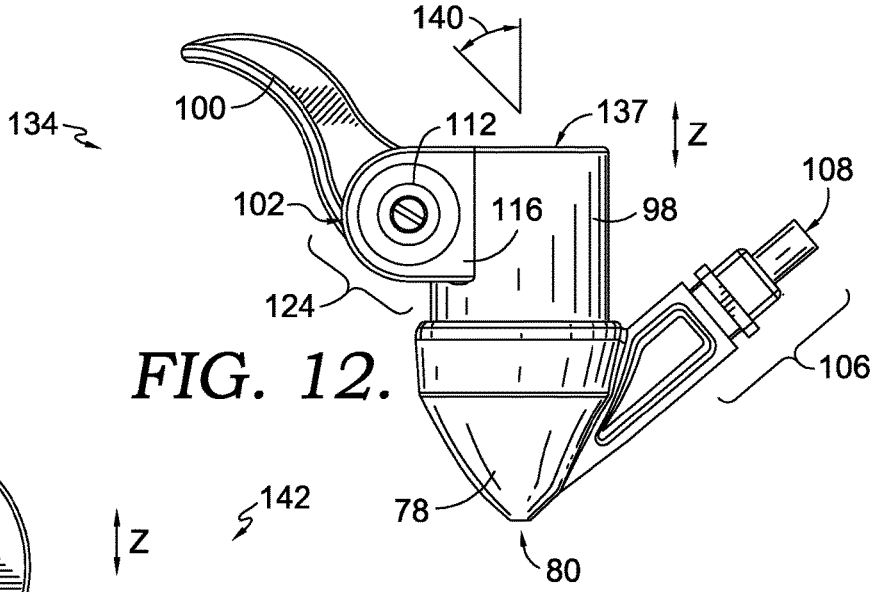
FIG. 12 is a side view of a locked marker positioner for securing a miniature-sized marking device in a marker airbrush device, in accordance with an embodiment of the invention.
Figure 13:
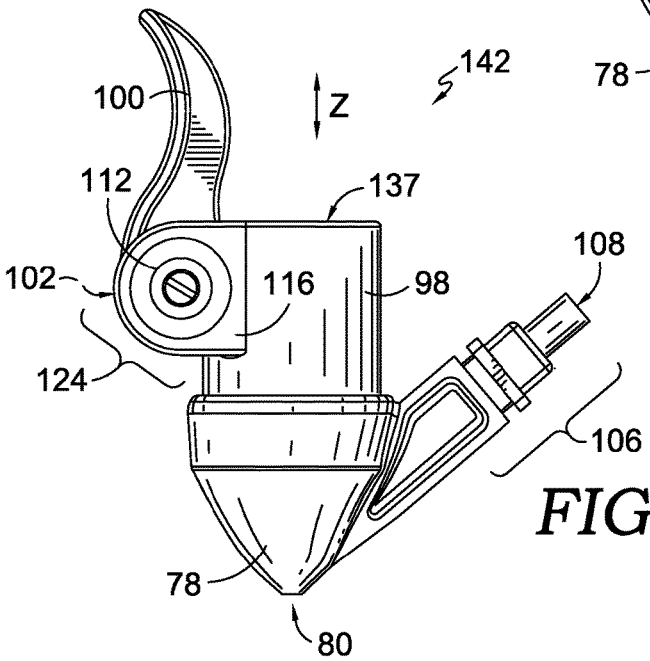
FIG. 13 is a side view of a locked marker positioner for securing a regular-sized marking device, in accordance with an embodiment of the invention.

For example, with reference to FIGS. 11-13, an exemplary marker positioner 134 is manipulated between an unlocked position (FIG. 11), a locked position corresponding to a miniature-sized marking device (FIG. 12), and a locked position corresponding to a regular-sized marking device (FIG. 13). In the unlocked position of FIG. 11, the locking lever 100 is positioned at a 90-degree angle 136 relative to a z-axis of the marker collar 98. As shown in FIG. 12, the locking lever 100 may be pivoted about the rotation joint 102 to orient the positioning mechanism 124 of the locking lever 100 at a particular angle 140 relative to the z-axis. In one embodiment, the particular angle 140 includes an angle between 0 and 90 degrees, such as a 45-degree angle. In embodiments, the position of the locking lever 100 in FIG. 12 secures a miniature-sized marking device 82 inside the marker airbrush device 94. With reference to FIG. 13, the locking lever 100 is pivoted into a position parallel to the z-axis, which orients the positioning mechanism 124 of the locking lever 124 into a position that secures a regular-sized marking device 82 inside the marker airbrush device 94. Accordingly, in embodiments of the invention, the positioning mechanism 124 on the locking lever 100 may be used to secure multiple sizes of marking devices 82 inside the marker airbrush device 94.

Figure 14:
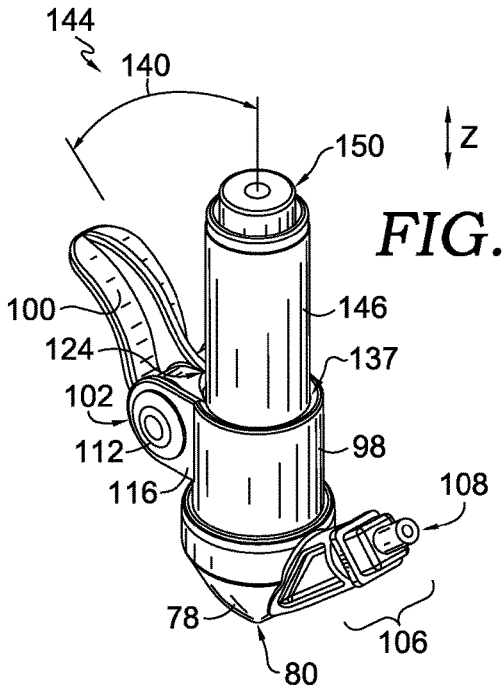
FIG. 14 is a perspective view of a locked marker positioner securing a miniature-sized marking device in a marker airbrush device, in accordance with an embodiment of the invention.
Figure 15:
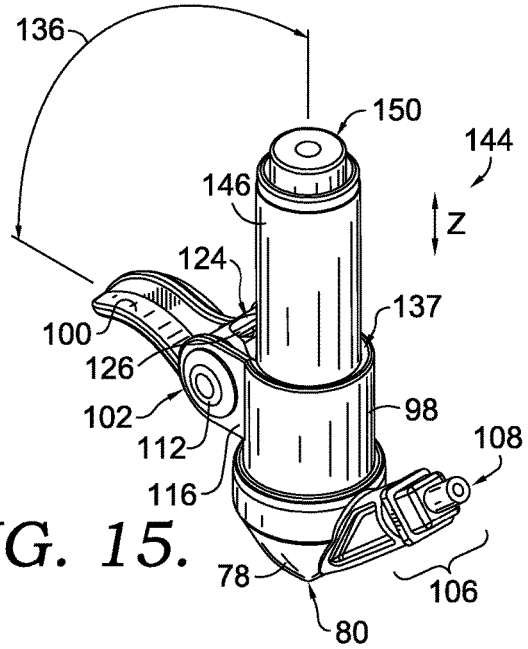
FIG. 15 is a perspective view of the marker airbrush device of FIG. 14, with the marker positioner in an unlocked position, in accordance with an embodiment of the invention.
Figure 16:
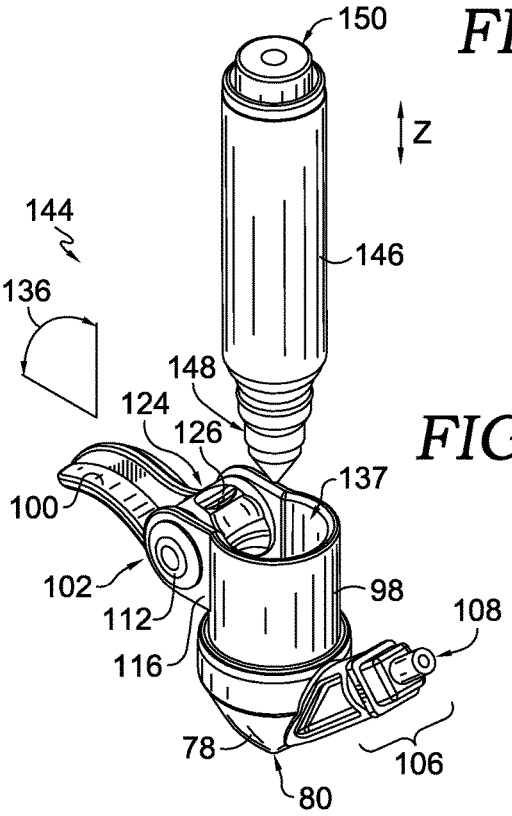
FIG. 16 is a perspective view of the marker airbrush device of FIG. 15, with the miniature-sized marker removed to reveal an interior of the marker positioner, in accordance with an embodiment of the invention.

An exemplary locked, unlocked, and separated view of a marker positioner 144 for use with a miniature-sized marking device 146 is depicted in FIGS. 14-16. In FIG. 14, marking device 146 is locked into a secured position adjacent the positioning mechanism 124, with locking lever at an angle 140. As such, the movement of the marking device 146 is restricted within the internal cavity 137 of marker collar 98, while only the second end 150 of the marking device 146 is exposed. In embodiments, the miniature-sized marking device 146 is restricted from movement within the internal cavity 137 of the marker collar 98 based on the angle 140 of the locking mechanism 100 engaging the locking segment 126 against at least a portion of the marking device 146, such as a marker collar and/or housing. Upon rotation of the locking lever 100 to a position perpendicular to the marking device 146, at angle 136 shown in FIG. 15, the marking device 146 is removable from the marker collar 98 based on the separation of locking segment 126 (and at least a portion of the positioning mechanism 124) from the outer surface of the marking device 146. Further, as shown in FIG. 16, the first end 148 of the marking device 146 may be removed from the marker positioner 144 based on decoupling of the marker positioner 144 and the marking device 146 upon unlocking of the locking lever 100.

Figure 17:
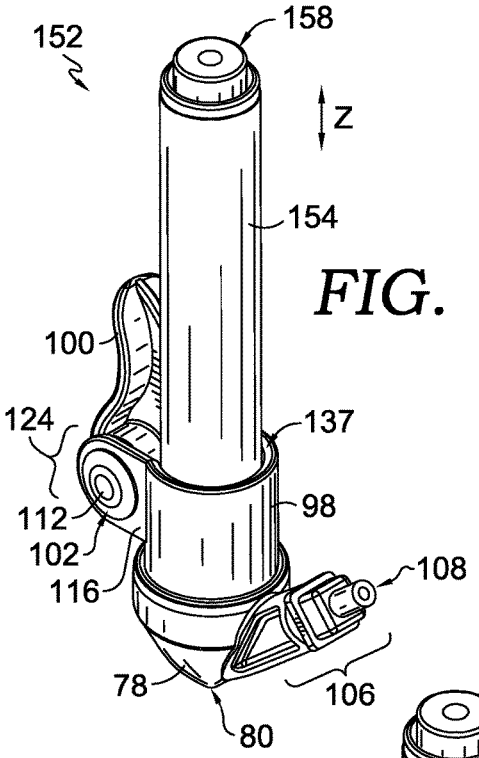
FIG. 17 is a perspective view of a locked marker positioner securing a regular-sized marking device in a marker airbrush device, in accordance with an embodiment of the invention.
Figure 18:
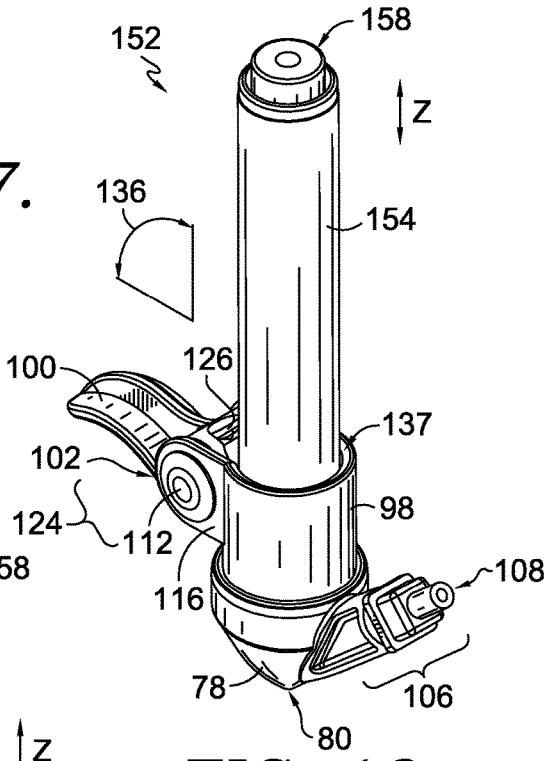
FIG. 18 is a perspective view of the marker airbrush device of FIG. 17, with the marker positioner in an unlocked position, in accordance with an embodiment of the invention.
Figure 19:
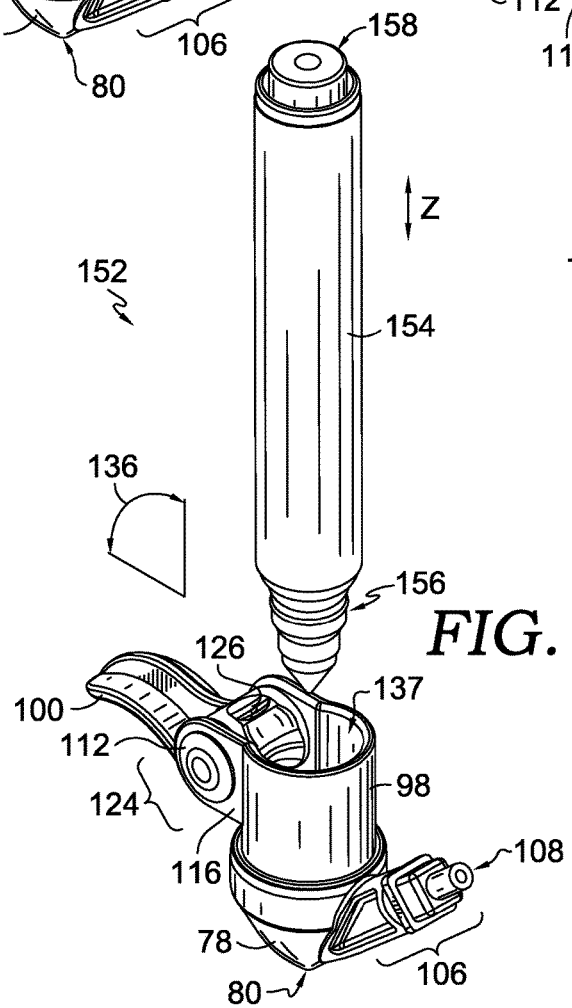
FIG. 19 is a perspective view of the marker airbrush device of FIG. 18, with the regular-sized marking device removed to reveal an interior of the marker positioner, in accordance with an embodiment of the invention.

Turning now to FIGS. 17-19, an exemplary locked, unlocked, and separated view of a marker positioner 152 for use with a regular-sized marking device 154 is depicted according to embodiments of the invention. In FIG. 17, marking device 154 is locked into a secured position adjacent the positioning mechanism 124, with locking lever at a position parallel to the z-axis of the marker collar 98. As such, the movement of the marking device 154 is restricted within the internal cavity 137 of marker collar 98, while only the second end 158 of the marking device 154 is exposed. In embodiments, the regular-sized marking device 154 is restricted from movement within the internal cavity 137 of the marker collar 98 based on the parallel positioning of the locking mechanism 100 engaging the locking segment 126 against at least a portion of the marking device 154, such as a marker collar and/or housing. Upon rotation of the locking lever 100 to a position perpendicular to the marking device 154, as shown in FIG. 18, the marking device 154 is removable from the marker collar 98 based on the separation of locking segment 126 (and at least a portion of the positioning mechanism 124) from the outer surface of the marking device 154. Further, as shown in FIG. 19, the first end 156 of the marking device 154 may be removed from the marker positioner 152 based on decoupling of the marker positioner 152 and the marking device 154 upon unlocking of the locking lever 100.

Figure 20:
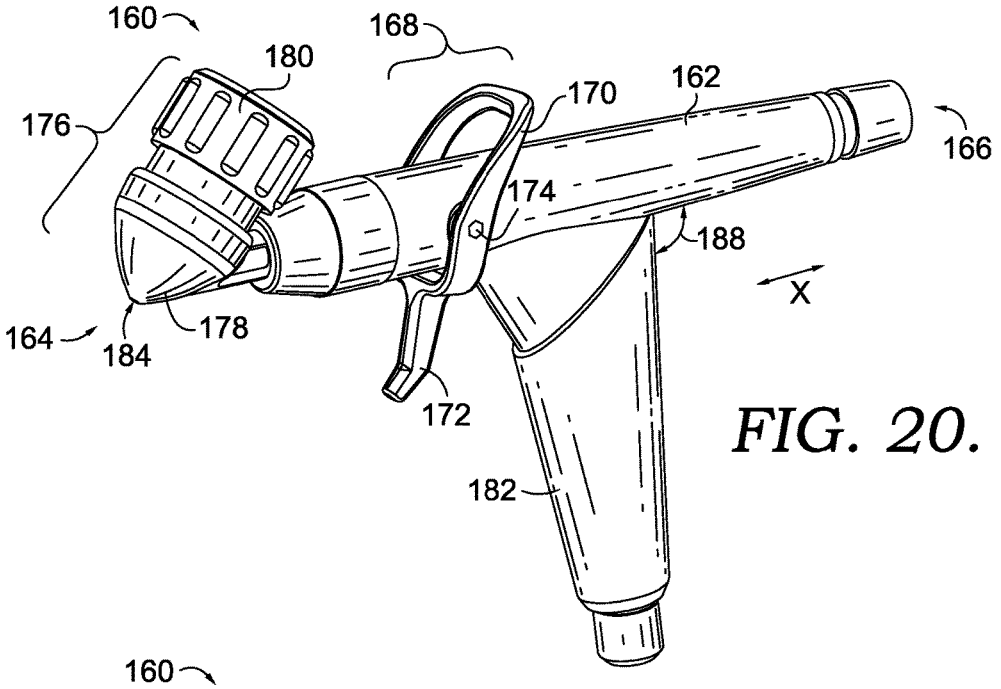
FIG. 20 is a perspective view of a marker airbrush device using a dual-action trigger, in accordance with an embodiment of the invention.
Figure 21:
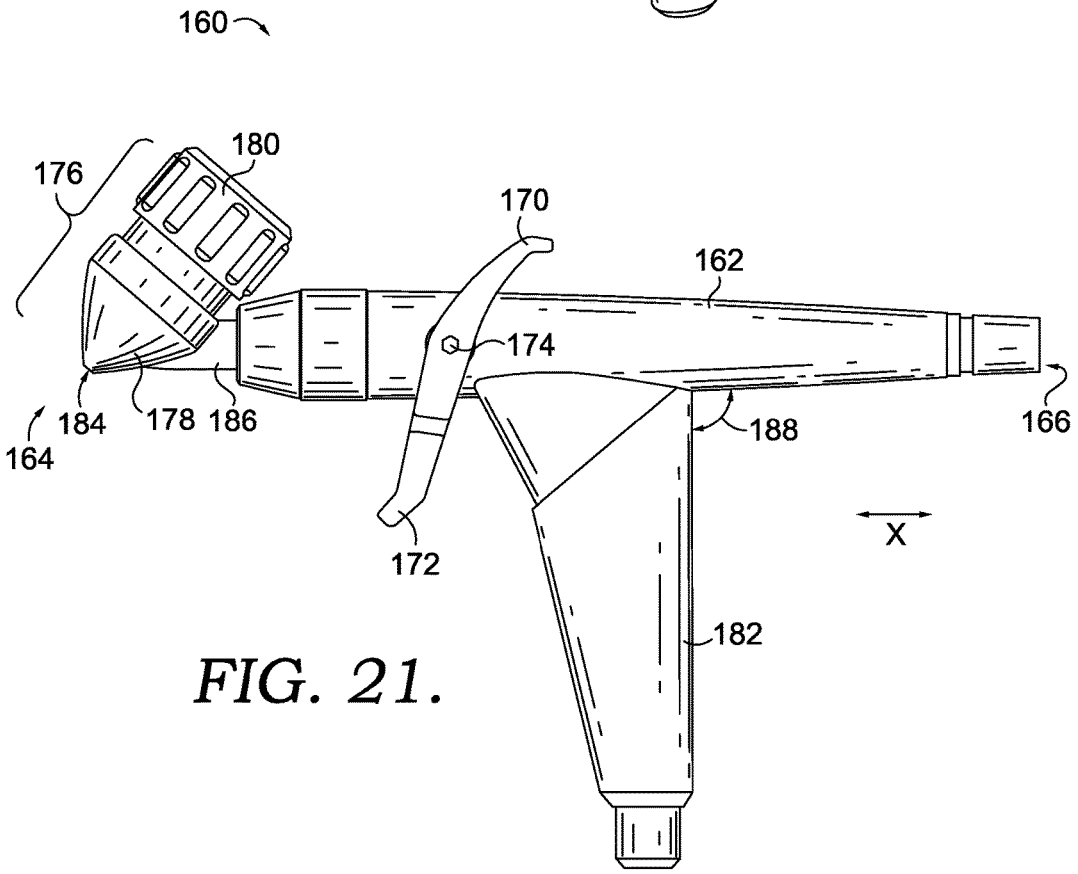
FIG. 21 is a side view of the marker airbrush device of FIG. 20, in accordance with an embodiment of the invention.

FIGS. 20-27 depict an embodiment of a marker airbrush utilizing a dual-action trigger 168. In FIG. 20, a perspective view of a marker airbrush device 160 is provided, while a side view of the marker airbrush 160 is provided in FIG. 21. The marker airbrush device 160 may include an airbrush housing 162, a maker positioner 176, a dual-action trigger 168, and a handle 182. The airbrush housing 162 may further comprise a first end 164 and a second end 166 along a horizontal axis X. At the first end 164, the airbrush housing 162 may be coupled to the marker positioner 176 via a connection mechanism 186. As such, the marker positioner 176 may be positioned external and adjacent to the airbrush housing 162, along the common horizontal axis X, permitting transfer of air from the airbrush housing 162 through the connection mechanism 186, and towards the opening 184. In one aspect, the marking device is secured by the external marker positioner 176, preserving the marking solution associated with the marker nib by forming a seal around the circumference of the marker barrel. For example, the marking device may be protected from air exposure, such as the air circulating within one or more passageways of the airbrush housing 162, and may further be protected from additional air outside the marker positioner 176 (i.e., beyond the edge of the rotatable collar 180).

Embodiments of the marker positioner 176 include a conical tip 178, a rotatable collar 180 that rotates around a circumference of a marking device (not shown), and an opening 184. In some aspects, an angle of the marker positioner 176 relative to the horizontal axis X of the airbrush housing 162 is greater than zero degrees, with the airflow through the marker airbrush housing 162 contacting at least a portion of a marker nib secured inside the marker positioner 176.

Similar to embodiments described with respect to FIGS. 1-19, the marker positioner 176 may be configured, via the rotatable collar 180, to couple a marking device to the marker airbrush device 160 and position a marker first end of a marking device at a particular position with respect to an air outlet, similar to the embodiment shown in FIG. 2. Specifically, the marker first end may comprise a marker nib portion and a marking housing collar adjacent the marker nib portion. As such, the marker positioner 176 may position the marker nib portion at first non-collinear angle relative to an air outlet and the marker housing collar a second non-collinear angle relative to the air outlet such that air traveling through the air outlet contacts at least a portion of the marker nib portion at the first non-collinear angle and at least a portion of the marker housing collar at the second non-collinear angle to transfer marking solution from the marking device to a writing surface. In exemplary embodiments, the first and second non-collinear angles are less than 90 degrees and greater than 0 degrees. The point of contact between the air traveling through the air outlet and the marker nib portion and the marker housing collar may be internal to the airbrush housing 162 while the transfer of the marking solution to the writing surface occurs externally from the airbrush housing 162. Additionally, while the marker positioner 176 positions the marker first end inside the marker airbrush device 160, a marker second end of the marking device opposite the marker first end may remain external to the airbrush housing.

In embodiments, a dual-action trigger 168 may be coupled to the airbrush housing 162 at a midpoint 174 between the first end 164 and the second end 166. The dual-action trigger 168 may comprise a top trigger 170 and a bottom trigger 172. As shown in FIG. 20, the dual-action trigger 168 may be an oblong-shaped ring around the airbrush housing 162. The top portion of the ring may form the top trigger 170, whereas a protrusion along the bottom portion of the ring may form the bottom trigger 172. The dual-action trigger 168 may be coupled to the airbrush housing 162 at midpoint 174 such that the dual-action trigger 168 can rotate, at least partially, around midpoint 174. Other configurations may be used to form the dual-action trigger 168 in other embodiments.

The handle 182 may be attached along the bottom portion of the airbrush housing 162 at some point between the first end 164 and the second end 166. In some embodiments, the angle 188 formed by the back surface relative to the horizontal axis X of the airbrush housing 162 may be 90 degrees. In other embodiments, as shown in FIG. 1, the angle 188 may be less than 90 degrees. The handle 182 may have a smooth, flat surface or may be ribbed for easier gripping.

Figure 22:
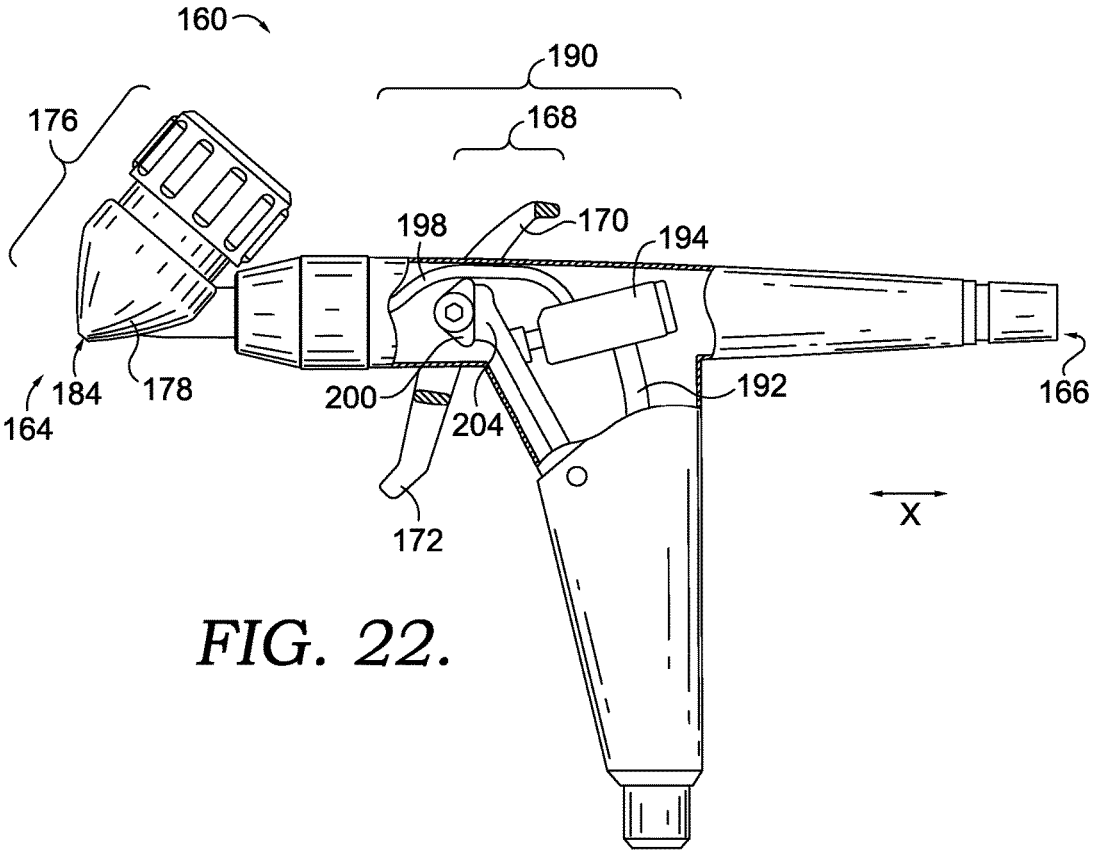
FIG. 22 is a side view of the marker airbrush device of FIG. 20 with a portion of the marker cut away, in accordance with an embodiment of the invention.
Figure 23:
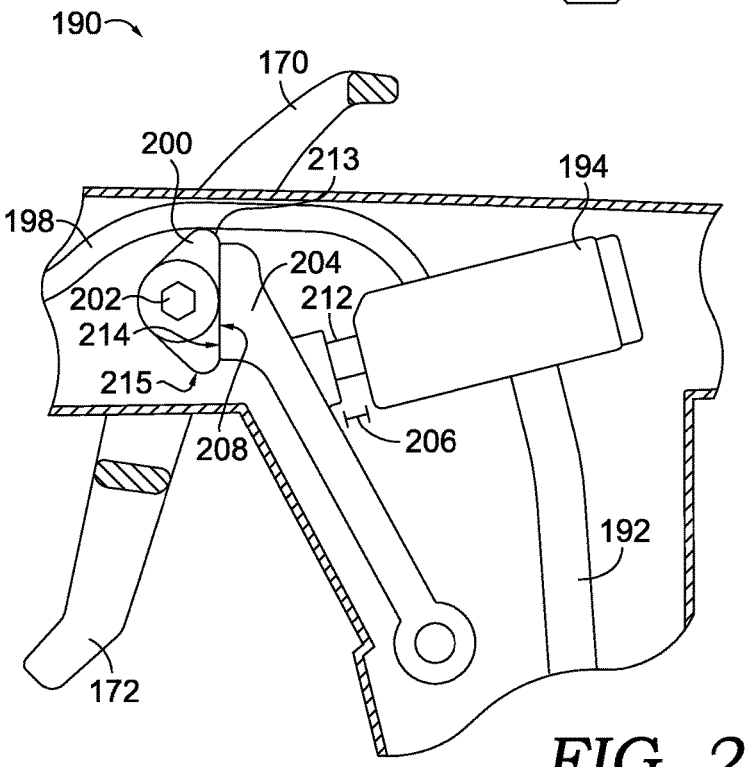
FIG. 23 is an enlarged, side view of the marker airbrush device of FIG. 20 with the valve system closed, in accordance with an embodiment of the invention.

Turning to FIGS. 22-23, the dual-action trigger 168 may control the flow of air to the marker positioner 176 and the opening 184 through a valve system 190 located within the airbrush housing 162. The valve system 190 may comprise an incoming air supply 192, an air reservoir 194, an outgoing air supply 198, a cam 200, a rotational cam point 202, an arm structure 204, and a pushrod 212. An incoming air supply 192 may bring air into an air reservoir 194 inside the airbrush housing 162. The incoming air supply 192 may be tubing running from the air reservoir 194 down the handle 182 and may exit the airbrush 160 through an opening on the distal end 196 of the handle 182. In other embodiments, the incoming air supply 192 runs from the air reservoir 194 along the horizontal axis X of the airbrush housing 162 and may exit the airbrush 160 through an opening at the second end 166 of the airbrush housing 162. The incoming air supply 192 may comprise a portion of tubing coupled to an air source, such as tubing 22 in FIG. 1 or tubing 74 in FIGS. 7-9, or may be coupled to such tubing. The air source may comprise a hand-pumping device or may comprise a motorized air pumping device.

The air reservoir 194 may also be coupled to an outgoing air supply 198. The outgoing air supply 198 may be tubing running from the air reservoir 194 towards the marker positioner 176 at the first end 164 of the airbrush housing 162. The outgoing air supply 198 may comprise a portion of the air outlet or may be coupled to the air outlet.

The air reservoir 194 also may be connected to a pushrod 212, which may be attached to an arm structure 204. In this embodiment, a flat surface 214 of the arm structure 204 may abut the cam 200. The cam 200 may have a rotational cam point 202, which may correspond to the midpoint 174 in FIGS. 20-21 at which the dual-action trigger 168 is connected to the airbrush housing 162. Movement of the dual-action trigger 168, which is connected to the cam 200 at the rotational cam point 202, may cause the cam 200 to rotate at least partially around the rotational cam point 202. The movement of the dual-action trigger 168 may be moving either the top trigger 170 or the bottom trigger 172, both of which would be sufficient to rotate the cam 200. Rotation of the cam 200 via the dual-action trigger causes the valve system 190 to move between a closed position and an open position.

FIGS. 22-23 show the valve system 190 in a closed position, such that air cannot travel from the air reservoir 194 into the outgoing air supply 198, in accordance with an embodiment of the invention. In the embodiment shown in FIGS. 22-23, the cam 200 is a triangular shape with at least one flat surface 208 between a top corner 213 and a bottom corner 215. In other embodiments, the cam 200 may be oblong or any other shape configured to move the arm structure 204 abutting the cam 200.

In an embodiment, while the valve system 190 is in the closed position, the flat surface 208 of the triangular cam 200 is parallel to and in contact with the flat surface 214 of the arm structure 204. Additionally, when the valve system 190 is in a closed position, the pushrod 212 is at a first length 206 between the arm structure 204 and the air reservoir 194.

Figure 24A:
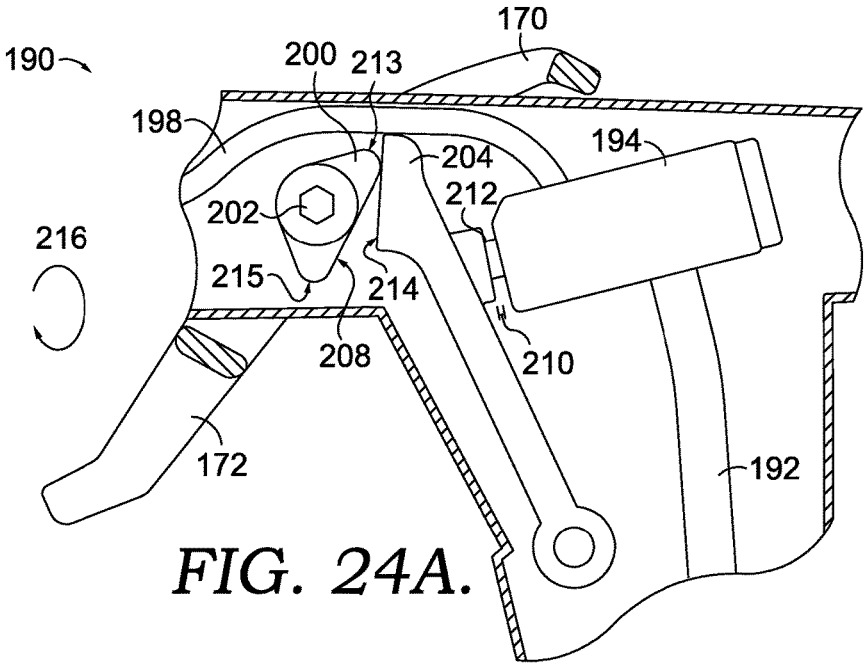
FIGS. 24A-B are enlarged, side views of the marker airbrush device of FIG. 20 with a portion cut away and the valve system open via the dual-action trigger, in accordance with an embodiment of the invention.
Figure 24B:
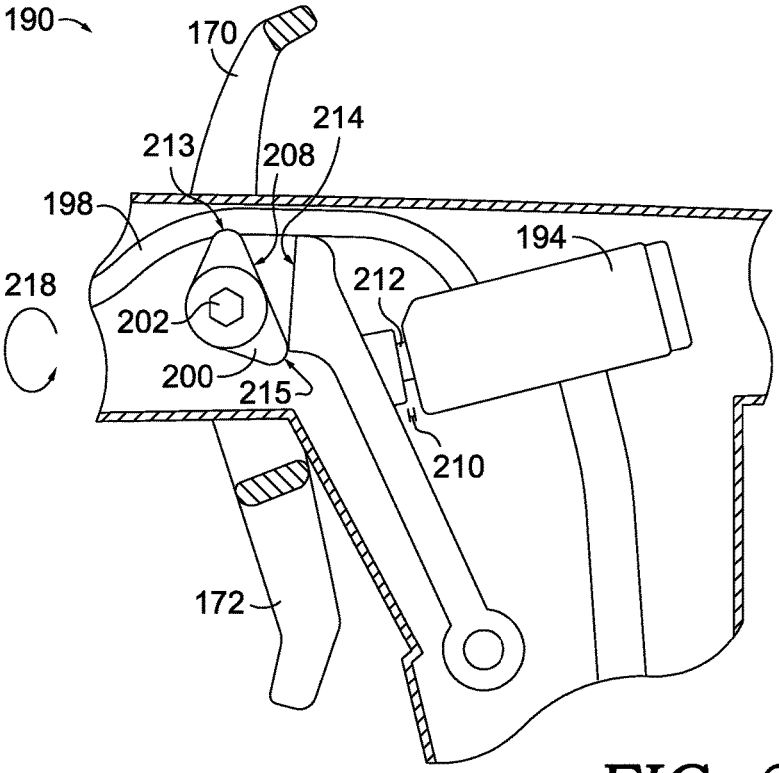

FIGS. 24A-B depict an open position of the value system 190, in accordance with an embodiment of the invention. In FIG. 24A, the top trigger 170 has been depressed or moved towards the second end 166 of the airbrush housing 162, which rotates the cam 200 in a first direction 216 around the rotational cam point 202, such that the flat surface 208 of the cam 200 may be no longer parallel to the flat surface 214 of the arm structure 204, and the top corner 213 may be in contact with the flat surface 214 of the arm structure 204. This rotation of the cam 200 may move the abutting arm structure 204, which, in turn, may move the pushrod 212 connected to the air reservoir 194. In the open position, the pushrod 212 may be at a second length 210, which is less than the first length 206. When the valve system 190 is in the open position, air may flow from the air reservoir 194 into the outgoing air supply 198.

In FIG. 24B, the valve system 190 is opened by pulling back the bottom trigger 172 towards the second end 166 of the airbrush housing 162, which may rotate the cam 200 in a second direction 218 around the rotational cam point 202. Rotation in the second direction 218 may cause the bottom corner 215 of the cam 200 to be in contact with the flat surface 214 of the arm structure 204. Rotation of the cam 200 in the second direction 218 may move the arm structure 204 in the same manner as accomplished by rotation of the cam 200 in the first direction 216. As such, use of either the top trigger 170 or the bottom trigger 172 of the dual-action trigger 168 may cause air to flow from the air reservoir 194 into the outgoing air supply 198 to allow use of the marker airbrush device 160.

Figure 25A:
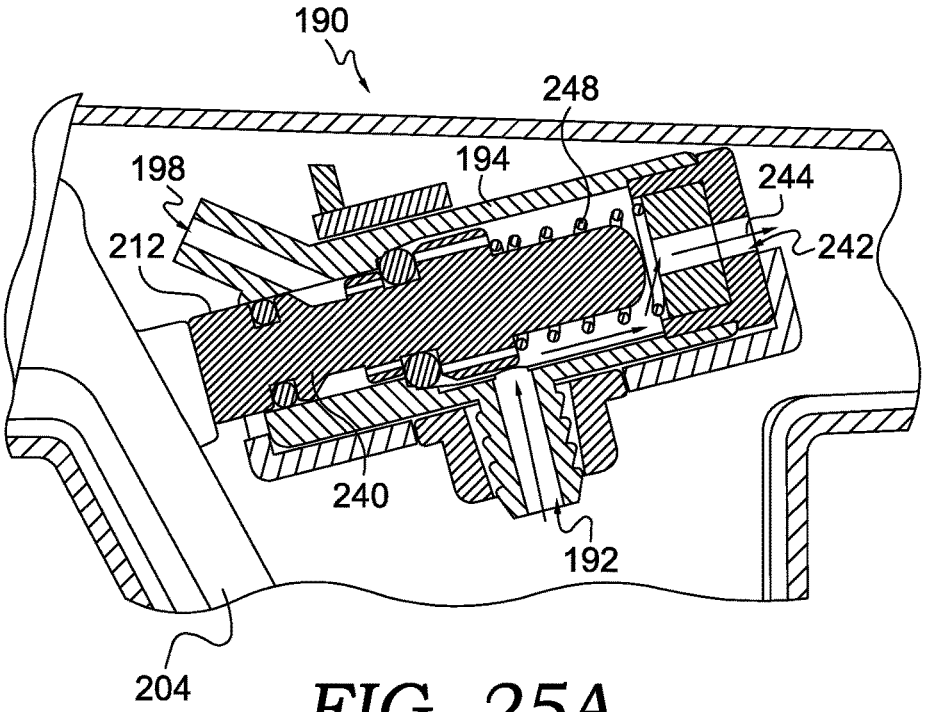
FIGS. 25A-B are enlarged, side views of the marker airbrush device of FIG. 20 with a portion cut away to show valve system within the air reservoir, in accordance with an embodiment of the invention.
Figure 25B:
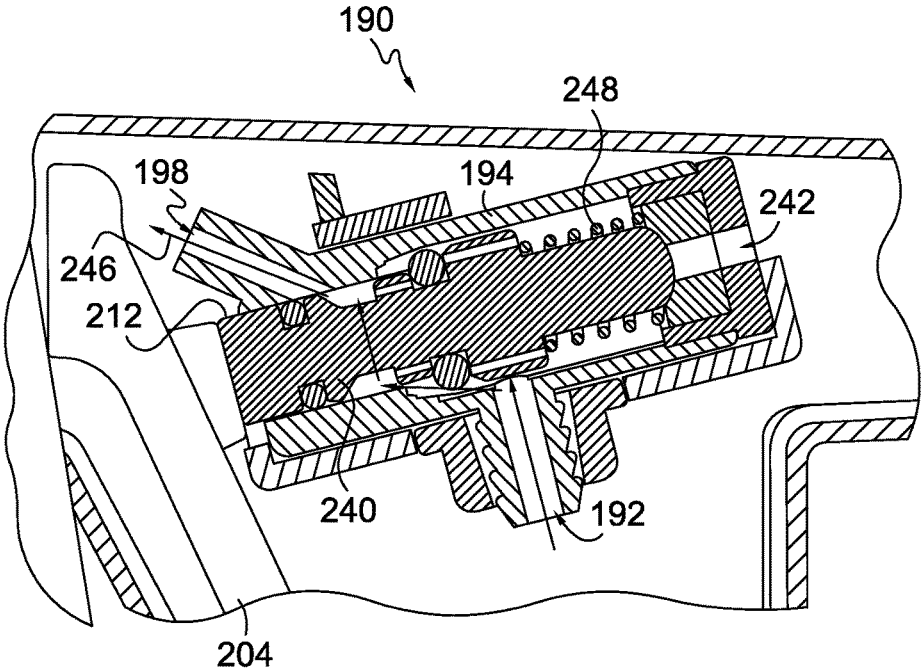

The air reservoir 194 may use various mechanisms for controlling airflow into the outgoing air supply 198 upon movement of the pushrod 212 connected to the air reservoir 194. FIGS. 25A-B depict cross-sectional views of one such mechanism within the valve system 190. As shown in FIGS. 25A-B, the pushrod 212 may be connected to or form a portion of an interior compartment 240 within the air reservoir 194. FIG. 25A shows the valve system in a closed position. In the closed position, the interior compartment 240 is positioned to obstruct a portion of the incoming air supply 192 such that air may escape through an opening 242 in the air reservoir 194 but only towards the second end 166 of the airbrush housing 162 (not shown in FIG. 25A), which is depicted by the path of arrows 244. In other words, when in the closed position, the air from the incoming air supply 192 is prevented from flowing towards the outgoing air supply 198 and a marker positioned within the marker positioner 176; yet, air may still escape the valve system. Allowing air to escape when in the closed position via this backflow mechanism prevents a buildup of excess air pressure within the airbrush housing, which may be particularly useful when using a motorized air pumping device that is providing a constant stream of pressurized air.

Turning to FIG. 25B, the valve system 190 is shown in an open position. When the dual-action trigger 168 is used, the interior compartment 240 is pushed towards the second end 166 of the airbrush housing 162 via the pushrod 212. In this position, the previously obstructed portion of the incoming air supply 192 is no longer obstructed such that air may travel through the air reservoir 194 towards the outgoing air supply 198, as shown by the path of arrows 246. In this position, the interior compartment 240 may now be blocking the opening 242 at the back of the air reservoir 194 so that all the air from the incoming air supply 192 is directed towards the outgoing air supply 198 for use with a marker.

Further, in some embodiments, the interior compartment 240 may be coupled to a spring mechanism 248 that moves the interior compartment to its position in the closed state. Accordingly, when the pushrod 212 is moved into an open position during a user's use of the dual-action trigger, the interior compartment 240 may be forced to move in a direction towards the spring mechanism 248 until interior compartment 240 blocks the opening 240 in the air reservoir 194 but allows air from the incoming air supply 192 to travel toward the outgoing air supply 198. When a user is no longer moving the pushrod 212 into an open position through use of the dual-action trigger 168, the spring mechanism may cause the interior compartment 240 to revert to its initial position in the closed state.

Figure 26:
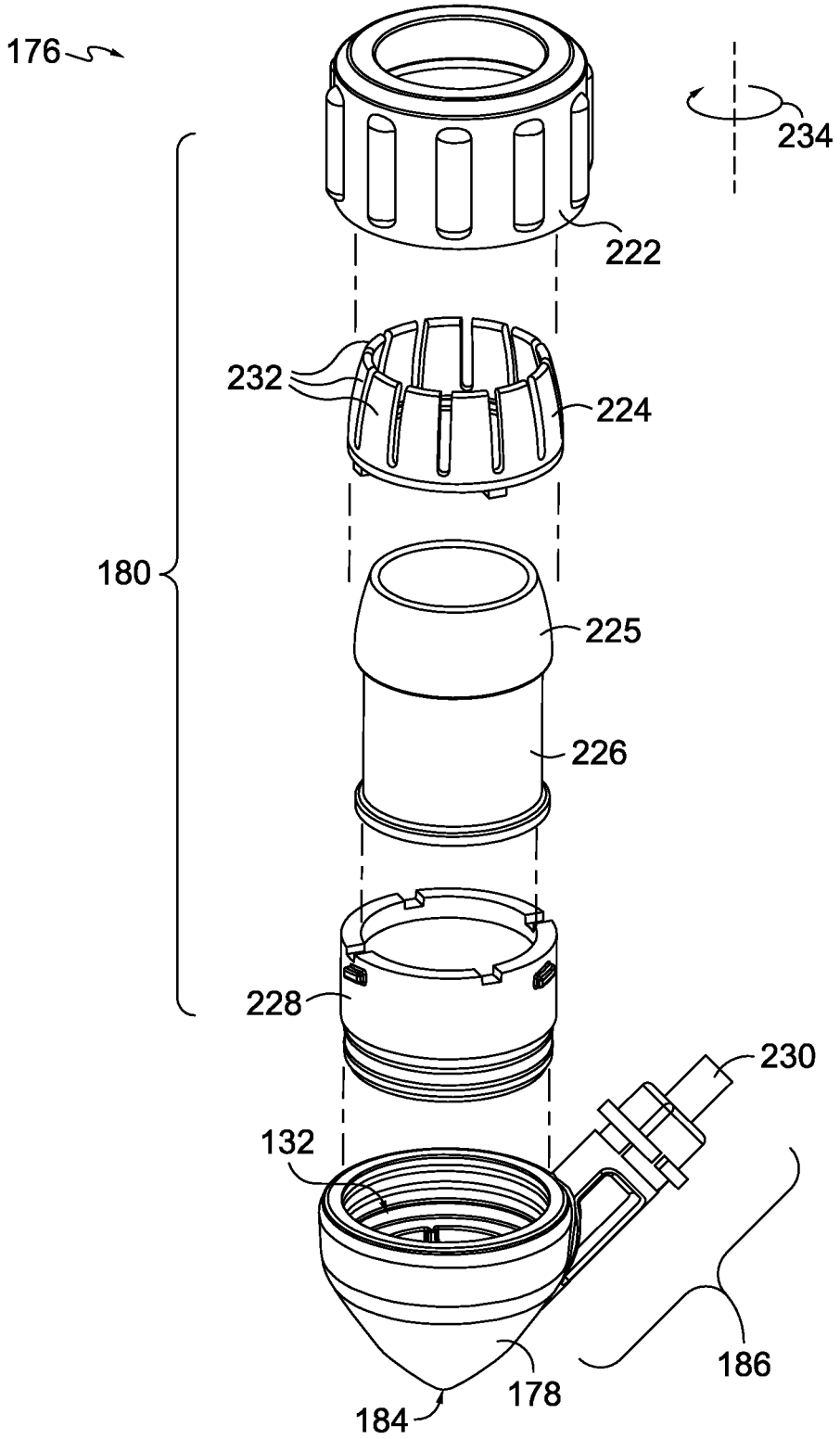
FIG. 26 is an exploded view of a marker positioner with a rotatable collar, in accordance with an embodiment of the invention.

Turning to FIG. 26, an exploded view of the marker positioner 176 is provided. The marker positioner 176 may comprise a conical tip 178, a connection mechanism 186, and a rotatable collar 180 having a plurality of collar pieces. The connection mechanism 186 couples the rest of the marker positioner 176 to the airbrush housing 162. The connection mechanism 186 may comprise tubing 230 that carries air from the outgoing air supply 198 into a hollow interior 132 of the conical tip 178. The conical tip 178 may taper towards an opening 184.

In some embodiments, such as the one illustrated in FIG. 26, the conical tip 178 of the marker positioner 176 may include a plurality of nib landings 236 extending from the tapered interior surface into the hollow interior 132. A marker nib of a marking device (not shown) may rest on the nib landings 236 when positioned within the marker positioner 176. The angle of the nib landings 236 on the tapered interior surface of the conical tip 18 with respect to a central axis through the opening 184 may correspond to the angle of a marker nib. For example, the angle of the nib landings 236 on the tapered interior surface with respect to a central axis may be between 15 degrees and 60 degrees.

Figure 27:
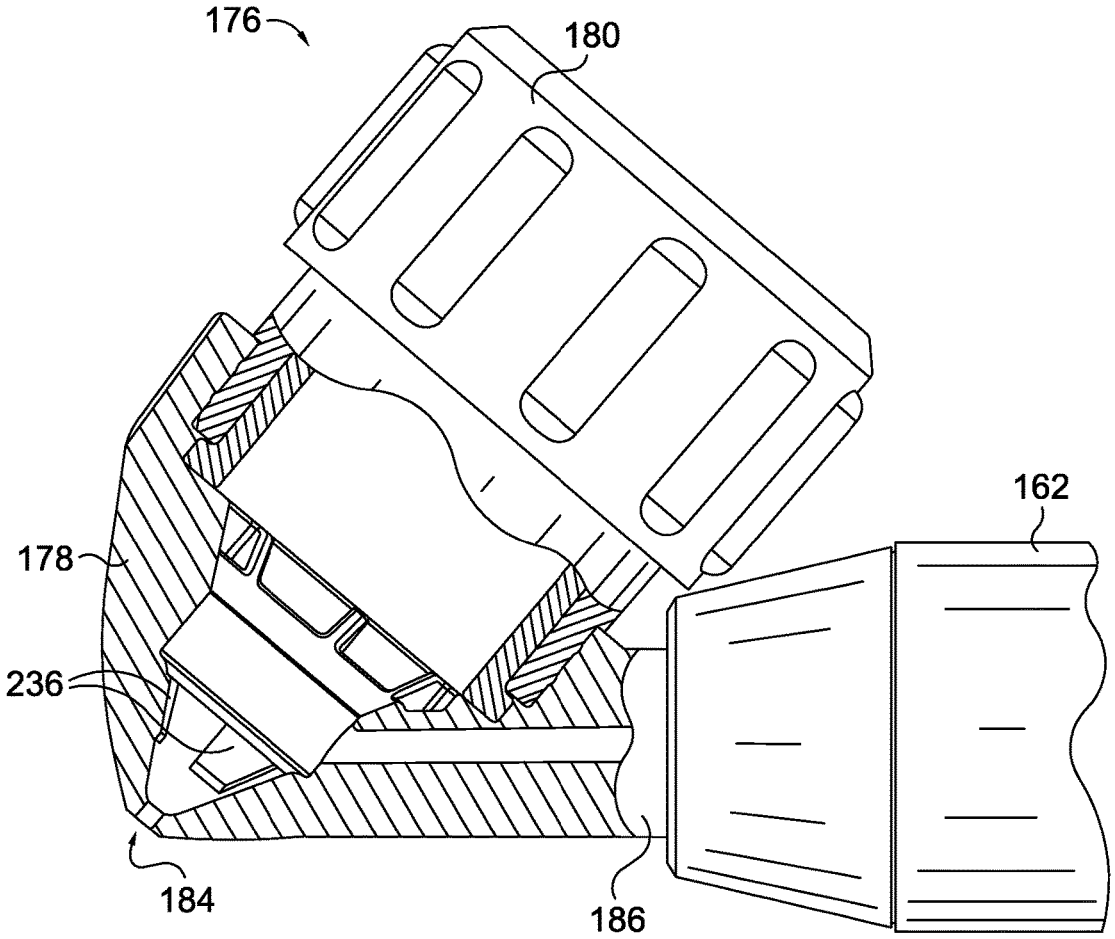
FIG. 27 is an enlarged, side view of a marker positioner with a portion cut away to show nib landings, in accordance with an embodiment of the invention.

Turning briefly to FIG. 27, in some embodiments, there may be three nib landings 236 evenly spaced around the circumference of the hollow interior 132 (not visible in FIG. 27) of the conical tip 178. The nib landings 236 may be designed so that a marking device can be dropped into the marker positioner 176 and positioned by the nib landings so that the marker nib of the marking device is at a particular depth with respect to the air outlet so that air traveling through the air outlet contacts the marker nib. The nib landings 236 may maintain the marker nib at a constant depth with respect to the air outlet. The nib landings 236 may also position a marker nib within the hollow interior 132 so that there is minimal contact between the marker nib and the tapered surface of the conical tip 178. In some embodiments, the nib landings 236 may position the marker nib so that there is between 0.080 inches to 0.100 inches between a marker nib and the tapered interior surface of the conical tip 178.

Continuing to the rest of the marker position 176 in FIG. 26, the conical tip 178 may be coupled to a rotatable collar 180 comprising one or more collar pieces. For example, an embodiment of the rotatable collar 180 in FIG. 26 comprises of a base collar 228, a sealing collar 226, a pronged collar 224, and an adjustable collar 222. In one embodiment, coupling of the rotatable collar 180 to the conical tip 178 around the marking device secures the marking device inside the marker positioner 176 such that the air flowing from the airbrush housing 162 contacts at least a portion of a marker nib on the marking device. Air contacting the marking device may be "targeted" to contact a particular portion of the marking device based on positioning of the marking device inside the marker positioner 176 (and the corresponding orientation of the marking device inside the hollow interior 132). In one example, air may travel across the nib of the marking device, collect an amount of marking solution in the air stream, and release a spray of marking solution out of the opening 184 to create an "airbrush" effect. In other words, the marker airbrush device 160 may transfer marking solution from a marking device (i.e., from the marker nib) out of the opening 184 and onto a writing surface.

The circumference of the base collar 228 may correspond to a circumference of the hollow interior 132 of the conical tip 178 such that the base collar 228 may be coupled to the conical tip 178. Similarly, the sealing collar 226 may have a circumference corresponding to the circumference of the base collar 228 and may be placed within the a hollow interior of the base collar 228. As shown in FIG. 26, the conical tip 178, the base collar 228, and the sealing collar 226 may be secured together via screw mechanisms, but in other embodiments, other coupling mechanisms may be used.

Next, the pronged collar 224 may be coupled to the sealing collar 226 by placing the pronged collar 224 around at least a portion of the sealing collar 226. In the embodiment illustrated, the sealing collar 226 comprises a bottom portion and a top portion, the top portion 225 protruding from the rest of the sealing collar 226. The pronged collar 224 may be coupled to the sealing collar 226 by engaging snap pieces on the base of the pronged collar 224 onto the top portion of the sealing collar 226. Other coupling mechanisms may be used, however. Finally, the adjustable collar 222 may be placed around the pronged collar 224.

The rotatable collar 180 may be designed to hold a marking device (not shown) in the marker positioner 176 and to prevent the pressurized air from exiting the marker airbrush device 160 aside from through the opening 184. As the user rotates the adjustable collar 222, the adjustable collar 222 may be slightly raised or lowered with respect to the rest of the rotatable collar 180. In one embodiment, as the user rotates the adjustable collar 222 in a direction 234, the adjustable collar 222 may be lowered and slightly tighten around the pronged collar 224. The pronged collar 224 may comprise a plurality of pronged structures 232 that are configured to be manipulated by rotation of the adjustable collar 222. In other words, as the adjustable collar 222 is rotated and tightens around the pronged collar 224, the plurality of pronged structures 232 may be pushed inward. Inward movement of the plurality of pronged structures 232 may place pressure around at least part of the sealing collar 226.

When a marking device (not shown) is placed within the marker position 176, an interior surface of the sealing collar 226 may be in contact with a surface of the marking device. Pressure put on the sealing collar 226 from rotation of the adjustable collar 222 may minimize any space between the interior surface of the sealing collar 226 and the marking device, sealing off a potential exit for the pressurized air. The sealing collar 226 may be constructed from a rubber material or another pliable material capable of forming a seal with the marking device.

As previously discussed, embodiments of the invention may utilize many different kinds of marking devices, having marker nibs saturated with multiple different types of marking solutions. For example, the marker airbrush device 160 may be used with a variety of broad line markers, such as Regular, Washable, Pip-Squeaks®, Crystal Effects, Window and Bright Fabric markers, by Crayola® LLC of Easton, Pa. As such, embodiments of the marking solution may be a washable marker solution, a non-washable marker solution, a fabric-writing marker solution, a window-writing marker solution, a special-effects marker solution and/or a permanent marker solution. Additionally, the marker airbrush device 160 may be used to transfer solution from a variety of different types of marking devices, including but not limited to markers having a marker nib and/or marker reservoir saturated in marking solution. In embodiments, the marking device is removable from marker airbrush device 160, such that multiple different marking devices may be used individually with marker airbrush device 160. In some embodiments, the marker positioner 176 may be adapted to secure different types of marking devices, such as marking devices having different circumferences or different shaped housings and/or nibs.

Figure 28:
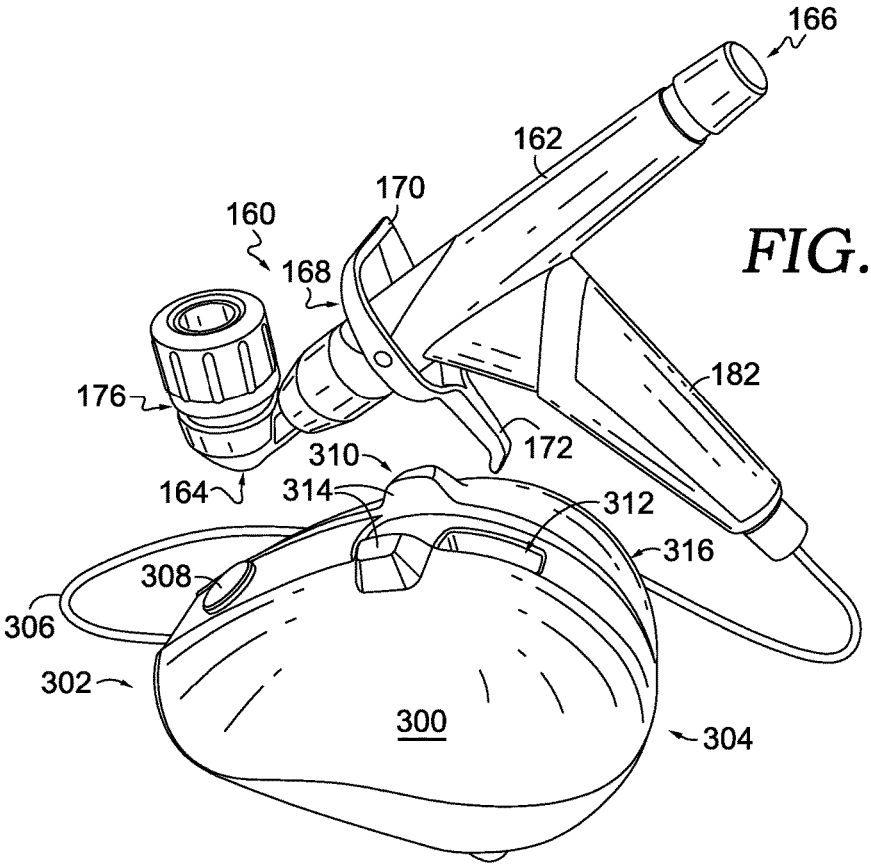
FIG. 28 is an exploded perspective view of the marker airbrush device of FIG. 20 and a base station, in accordance with an embodiment of the invention.
Figure 29:
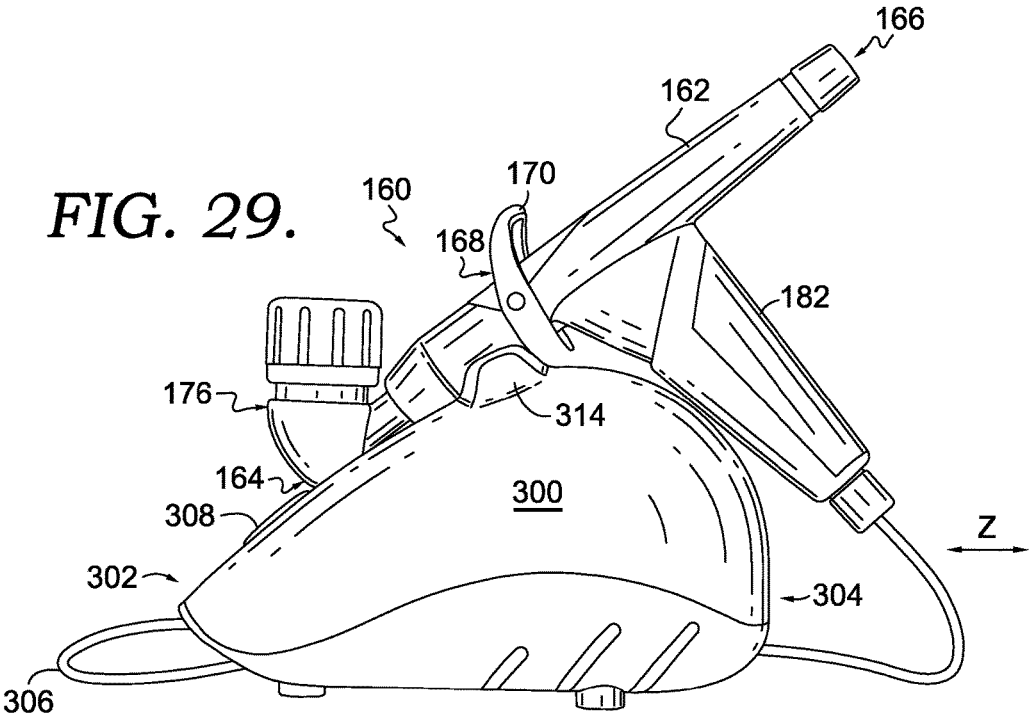
FIG. 29 is a side view of the marker airbrush device docked on the base station of FIG. 28, in accordance with an embodiment of the invention.

Turning to FIGS. 28-29, a base station 300 coupled to the marker airbrush device 160 is provided in accordance with embodiments of the invention. The base station 300 may be used as a docking area for the marker airbrush device 160 when not in use, as shown in FIG. 29. In some embodiments, the base station 300 may also serve as an electronic air pump to supply air to the marker airbrush device 160.

Accordingly, the base station 300 may include a first end 302 and a second end 304 opposite the first end 302 along a horizontal axis Z. Tubing 306 may be coupled to the second end 304 of the base station 300. The tubing 306 may also be coupled to the marker airbrush device 160, and air from the base station may be supplied to the marker airbrush device 160 via the tubing 306. Although not illustrated, an electrical power cord may be coupled to the first end 302 of the base station 300 such that the base station 300 may use electrical power to pump air to the marker airbrush device 160. The base station 300 may also include a power button 308 that a user may engage through a push of the power button 308, for example, to power the base station 300 on and off.

A top portion 310 of the base station 310 may provide a docking area for the marker airbrush device 160 when the marker airbrush device 160 is not in use. Specifically, the top portion 310 of the base station 300 may include a slot 312 configured to receive at least a portion of the marker airbrush device 160. In some aspects, the slot 312 is configured to receive the bottom trigger 172 of the dual-action trigger 168 of the marker airbrush device 160. As shown in FIG. 29, when the bottom trigger 172 is inserted into the slot 312 of the base station 300, the marker airbrush device 160 may rest on the top portion 310 of the base station 310. When the user is ready to use the marker airbrush device 160, the marker airbrush device 160 may be easily uncoupled from the top portion 310 of the base station 300 by lifting the marker airbrush so that bottom trigger 172 is no longer in the slot 312.

To help keep the marker airbrush device 160 on the base station 310, the top portion may further have two protrusions 314 extending upward from the top surface 316 of the base station 300. The protrusions 314 may be positioned on either side of the slot 312 to help maintain the marker airbrush device 160 in an upright position. Additionally, the top surface 316 of the base station 300 may be curved with the curvature being more pronounced at the second end 304 of the base station 300 and tapering off towards the first end 302. The curved top surface 316 may help to better position the marker airbrush device 160 on the base station 300. As the first end 164 of the airbrush housing 162 coupled to the marker positioner 176 may be heavier than the second end 166 of the airbrush housing 162, the first end 164 of the airbrush housing 162 may be angled downwards towards the first end 302 of the base station 300, following the curved top surface 316, while the second end 166 of the airbrush housing 162 and the handle 186 may be positioned at the second end 304 of the base station 300.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A marker airbrush device comprising:

an airbrush housing having a first end and a second end oriented along a horizontal axis, the airbrush housing comprising (i) an air outlet through which air travels at the first end and (ii) a dual-action trigger comprising a top trigger and a bottom trigger, wherein the dual-action trigger is configured to control an amount of air traveling through the air outlet by rotation of the dual-action trigger in a first direction or rotation of the dual-action trigger in a second direction opposite the first direction, wherein the dual action trigger is rotatably coupled to the airbrush housing at a midpoint between the top trigger and the bottom trigger; and a marker positioner coupled to the airbrush housing, the marker positioner having an opening through which air traveling through the air outlet exits the marker airbrush device, wherein the marker positioner positions a marker first end comprising at least a marker nib of a marking device at a particular angle relative to the airbrush housing such that air traveling through the air outlet contacts at least a portion of the marker nib of the marking device at the particular angle to transfer marking solution from the marking device onto a writing surface external to the airbrush housing.

2. The device of claim 1, wherein rotating the dual-action trigger in the first direction comprises moving the top trigger in a direction towards the second end of the airbrush housing and wherein rotating the dual-action trigger in the second direction comprises moving the bottom trigger towards the second end of the airbrush housing.

3. The device of claim 1 further comprising:

a tubing coupled to the airbrush housing; and a hand-pumping device coupled to the tubing, wherein air pumped from the hand-pumping device travels to the airbrush housing via the tubing.

4. The device of claim 1, wherein the airbrush housing further comprises:

a tubing coupled to the airbrush housing; and a motorized air pumping device coupled to the tubing, wherein air pumped from the motorized air pumping device travels to the airbrush housing via the tubing.

5. The device of claim 4, wherein the airbrush housing further comprises a valve system comprising:

an air reservoir;

a pushrod coupled to the air reservoir;

a rotatable cam; and an arm abutting the pushrod and abutting the rotatable cam, wherein the valve system is configured to move between an open position and a closed position via the dual-action trigger.

6. The device of claim 5, wherein the valve system includes one or more openings through which a portion of air exits the valve system when the valve system is in a closed position to prevent excess air pressure within the airbrush housing.

7. The device of claim 5, wherein moving the top trigger towards the second end of the airbrush housing rotates the rotatable cam in a first direction and moving the bottom trigger towards the second end airbrush housing rotates the rotatable cam in a second direction.

8. The device of claim 7, wherein rotating the rotatable cam at least in the first direction moves the pushrod via the arm and rotating the rotatable cam at least in the second direction also moves the pushrod via the arm, wherein moving the pushrod allows air to travel from the air reservoir and through the air outlet.

9. The device of claim 1, wherein the marker positioner further comprises an interior cavity in which the marker first end of the marking device is positioned, wherein the particular angle at which the marker nib is positioned by the marker positioner is less than 90 degrees and greater than zero degrees with respect to the horizontal axis.

10. A marker airbrush device comprising:

an airbrush housing having a first end and a second end oriented along a horizontal axis, the airbrush housing comprising (i) an air outlet through which air travels at the first end and (ii) a trigger for controlling an amount of air traveling through the air outlet;

a marker positioner coupled to the first end of the airbrush housing, wherein the marker positioner has (i) an opening through which air traveling through the air outlet exits the marker airbrush device and (ii) an interior cavity in which at least a marker first end comprising a marker nib portion of a marking device is positioned, the marker positioner positioning at least a portion of the marker nib of the marking device at a stationary depth relative to the air outlet and at a particular angle with respect to the horizontal axis such that air traveling through the air outlet contacts at least one surface of the marking device to transfer marking solution from the marking device onto a writing surface; and a rotatable collar that removeably couples at least a portion of the marker first end of the marking device to at least a portion of the marker positioner when the marker first end of the marking device is positioned within the interior cavity of the marker positioner, wherein the rotatable collar comprises (i) a base collar coupled to the marker positioner, (ii) a sealing collar with a top portion and a bottom portion, the bottom portion being positioned within the base collar, (iii) a pronged collar with a plurality of pronged structures around a circumference of the pronged collar, the pronged collar being positioned around the top portion of the sealing collar, and (iv) an adjustable collar rotatably coupled to an exterior of the pronged collar, wherein rotation of the adjustable collar in a first direction tightens the plurality of pronged structures around the sealing collar to create a seal between a portion of the sealing collar and a portion of the marking device.

11. The device of claim 10, wherein the marker positioner includes one or more nib landings protruding from an interior surface of the marker positioner into the interior cavity, wherein the one or more nib landings are configured to position the marker nib portion of the marking device within the marker positioner such that contact between the marker nib portion and the interior surface of the marker positioner is minimized.

12. The device of claim 10, wherein the particular angle at which the marker nib is positioned within the interior cavity of the marker positioner is less than 90 degrees and greater than zero degrees with respect to the horizontal axis.

13. The device of claim 10, wherein the trigger comprises a top trigger and a bottom trigger and is rotatably coupled to the airbrush housing at a midpoint between the top trigger and the bottom trigger.

14. The device of claim 13, wherein the trigger is configured to control an amount of air traveling through the air outlet by rotation of trigger in a first direction or rotation of the trigger in a second direction opposite the first direction, wherein rotating the trigger in the first direction comprises moving the top trigger in a direction towards the second end of the airbrush housing and wherein rotating the trigger in the second direction comprises moving the bottom trigger towards the second end of the airbrush housing.

15. A marker airbrush device comprising:

an airbrush housing having a first end and a second end oriented along a horizontal axis, an air outlet through which air travels at the first end, a dual-action trigger, and a valve system, wherein the dual-action trigger comprises a top trigger and a bottom trigger configured to control an amount of air traveling through the air outlet by moving at least the top trigger or at least the bottom trigger, and further wherein the valve system is positioned within the airbrush housing and is configured to move between an open position and a closed position in response to an amount of air traveling through the air outlet as controlled via the dual-action trigger;

a marker positioner coupled to the first end of the airbrush housing, wherein the marker positioner has (i) an opening through which air traveling through the air outlet exits the marker airbrush device and (ii) an interior cavity in which a marker first end comprising a marker nib portion is positioned, the marker positioner positioning at least a portion of the marker nib portion of a marking device at a particular angle less than 90 degrees and greater than zero degrees with respect to the horizontal axis such that air traveling through the air outlet contacts at least one surface of the marker nib portion to transfer marking solution from the marking device onto a writing surface; and a rotatable collar that removeably couples at least the marker first end of the marking device to at least a portion of the marker positioner when the marking device is positioned within the interior cavity of the marker positioner.

16. The device of claim 15, wherein the rotatable collar comprises one or more collar pieces that secure the marker first end of the marking device within the interior cavity of the marker positioner and that create a seal between the marking device and the rotatable collar.

17. The device of claim 15 further comprising:

a tubing coupled to the airbrush housing; and a motorized air pumping device coupled to the tubing, wherein air from the motorized air pumping device travels to the valve system via the tubing and selectively travels through the valve system to the air outlet when in the open position in response to moving at least the top trigger or at least the bottom trigger.

18. The device of claim 15, wherein the dual-action trigger is rotatably coupled to the airbrush housing at a midpoint between the top trigger and the bottom trigger.

19. The device of claim 18, wherein rotating the dual-action trigger in a first direction comprising moving the top trigger in a direction towards the second end of the airbrush housing and wherein rotating the dual-action trigger in a second direction comprising moving the bottom trigger towards the second end of the airbrush housing.

* * * * *